US006089855A

United States Patent [19]

Becker et al.

[11] Patent Number: 6,089,855

[45] Date of Patent: Jul. 18, 2000

[54] LOW $NO_X$ MULTISTAGE COMBUSTOR

[75] Inventors: Frederick E. Becker, Reading, Mass.; Ronald W. Breault, Newington, N.H.; Anthony F. Litka, Hanover, Mass.; Andrew W. McClaine, Lexington, Mass.; Kailash Shukla, Boxborough, Mass.

[73] Assignee: Thermo Power Corporation, Waltham, Mass.

[21] Appl. No.: 09/113,952

[22] Filed: Jul. 10, 1998

[51] Int. Cl.[7] ..... F23M 3/00

[52] U.S. Cl. ..... 431/9; 431/10; 431/116; 431/173; 431/351; 431/352

[58] Field of Search ..... 431/9, 10, 115, 431/116, 160, 173, 351, 352; 60/752, 755, 757

[56] References Cited

U.S. PATENT DOCUMENTS

| | | | |
|---|---|---|---|
| 2,398,654 | 4/1946 | Lubbock et al. | 60/755 |
| 2,525,206 | 10/1950 | Clarke | 60/752 |
| 2,769,411 | 11/1956 | Simmons | 110/28 |
| 3,589,128 | 6/1971 | Sweet | 60/757 |
| 4,029,557 | 6/1977 | Christensen et al. | 204/149 |
| 4,130,388 | 12/1978 | Flanagan | 431/116 |
| 4,422,388 | 12/1983 | Raskin | 110/261 |
| 4,445,844 | 5/1984 | Matthews | 431/170 |
| 4,454,838 | 6/1984 | Strohmeyer, Jr. | 122/4 D |
| 4,624,191 | 11/1986 | Zauderer et al. | 110/264 |
| 4,651,654 | 3/1987 | Erlandsson et al. | 110/254 |
| 4,679,511 | 7/1987 | Holmes et al. | 110/216 |
| 4,704,084 | 11/1987 | Liu et al. | 431/7 |
| 4,708,092 | 11/1987 | Engstrom | 122/4 D |
| 4,721,454 | 1/1988 | Schirmer et al. | 431/352 |
| 4,881,476 | 11/1989 | Becker et al. | 110/347 |
| 4,920,925 | 5/1990 | Korenberg et al. | 122/149 |
| 4,989,549 | 2/1991 | Korenberg | 431/173 |
| 5,220,888 | 6/1993 | Khinkis et al. | 122/136 R |

FOREIGN PATENT DOCUMENTS

| | | | |
|---|---|---|---|
| 550738 | 9/1956 | Belgium | 431/116 |
| 1220544 | 7/1966 | Germany | 431/116 |

OTHER PUBLICATIONS

Chojnacki et al.,"Developments in Ultra–Low NOx Burner/Boilers", 1992 International Gas Research Conference, pp. 351–361.

Cygan et al., "Ultra–Low Emissions Burner for Industrial Boilers", 1995 International Gas Research Conference, V.5: Industrial Utilization, Canne, France, Nov. 6–9, 1995, pp. 384–394.

Delavan, "Swirl–Air Combustion Air Atomizing Nozzles", Product Brochure, no later than 1996.

(List continued on next page.)

*Primary Examiner*—Carroll Dority
*Attorney, Agent, or Firm*—Fish & Richardson P.C.

[57] ABSTRACT

A high efficiency, Vortex Inertial Staged Air (VIStA) combustor provides ultra-low $NO_X$ production of about 20 ppmvd or less with CO emissions of less than 50 ppmvd, both at 3% $O_2$. Prompt $NO_X$ production is reduced by partially reforming the fuel in a first combustion stage to CO and $H_2$. This is achieved in the first stage by operating with a fuel rich mixture, and by recirculating partially oxidized combustion products, with control over stoichiometry, recirculation rate and residence time. Thermal $NO_X$ production is reduced in the first stage by reducing the occurrence of high temperature combustion gas regions. This is achieved by providing the first stage burner with a thoroughly pre-mixed fuel/oxidant composition, and by recirculating part of the combustion products to further mix the gases and provide a more uniform temperature in the first stage. In a second stage combustor thermal $NO_X$ production is controlled by inducing a large flow of flue gas recirculation in the second stage combustion zone to minimize the ultimate temperature of the flame. One or both of the first and second stage burners can be cooled to further reduce the combustion temperature and to improve the recirculation efficiency. Both of these factors tend to reduce production of $NO_X$.

55 Claims, 15 Drawing Sheets

OTHER PUBLICATIONS

Kirk–Othmer, "Encyclopedia of Chemical Technology", 4th Ed., vol. 6, Wiley–Interscience Publication, NY, no later than 1996.

Roberts et al., "An Ultra–Low Emissions Forced Internal Recirculation Burner for Boilers and Process Heaters", 1995 International Gas Research Conference.

Syska et al., "Low Nox High Performance Industrial Burner", 1992 International Gas Research Conference, pp. 328–333.

Vol. V: Industrial Utilization, Cannes, France, pp. 404–412, Nov. 6–9, 1995.

Letter to U.S. Dept. of Energy with response to DOE RFP No. DE–PS07–941D13285, May 5, 1984.

Low NOx Burner Development Program, Quarterly Progress Report for Oct. 1, 1996—Dec. 31, 1996. submitted to US DOE in first quarter of 1997.

Ultra Low NO Burner for Direct Air Heating, Institute of Gas Technology, no date.

Low NOx Burner For Firetube Boilers, Institute of Gas Technology, no date.

Low NOx Forced Internal Recirculation Burner, Institute of Gas Technology, no date.

Low NOx Burner Development Program, Quarterly Progress Report for Apr. 1, 1997—Jun. 30, 1997, submitted to U.S. DOE in third quarter of 1997.

LOW $NO_X$ MULTISTAGE COMBUSTOR

STATEMENT AS TO FEDERALLY SPONSORED RESEARCH

The U.S. government has rights to this invention pursuant to Contract No. DE-FC07-96ID13470 awarded by the Department of Energy.

BACKGROUND OF THE INVENTION

The invention relates to combustion furnaces, and, in particular, to a multi-stage combustor adapted for reduced emissions of $NO_X$ combustion products.

The market for industrial combustion equipment in the United States is shaped in large part by federal regulations governing air standards in urban areas, as mandated by the Clean Air Act (CAA), as amended. Industrial expansion can be limited in areas that do not meet National Ambient Air Quality Standards (NAAQS) for the emissions of certain combustion gases, such as $NO_2$. New sources of $NO_X$ in non-attainment areas must use emission offsets and a tight level of control known as "lowest achievable emission rate (LAER)." A target $NO_X$ emission no greater than 9 ppmvd (parts per million by volume on a dry basis with 3% $O_2$ in the emission) is usually established for new sources in non-attainment areas. The Clean Air Act also sets standards for ambient ozone in non-attainment areas and in other areas called "ozone transport regions," which meet the standard but into which ozone can migrate. New sources in some of the ozone non-attainment areas will be subject to the same LAER $NO_X$ target levels.

The 1990 amendments to the CAA affects smaller sources than previous regulations and consequently will impact industrial scale furnaces and boilers directly. The usual method to reduce $NO_X$ emissions to meet the LAER standards is to post-process exhaust gases employing selective catalytic reduction.

SUMMARY OF THE INVENTION

According to the invention, a Vortex Inertial Staged Air (VIStA) combustor includes two combustion chambers, or combustion zones, that are connected in series. The second combustion chamber can be part of a furnace. A gaseous fuel, such as natural gas, is premixed with about 45% to about 90% stoichiometric air. The fuel/air mixture is tangentially admitted into one end of a substantially cylindrical-shaped first stage chamber at high velocity through multiple ports, whereupon it is ignited. This creates a vortical flow moving towards the opposite end of the first chamber. By exploiting the radial pressure difference created in the first chamber by the vortical flow, a portion of the partially oxidized combustion products are taken out of the first chamber through tangential openings located near an axial opening to the second chamber. One or more recirculation tubes return these gases axially into the first mentioned end of the first chamber at a central opening. The stoichiometry, recirculation rate, and residence time are controlled to partially reform the natural gas in the first chamber to minimize the hydrocarbon and nitrogen-bound compounds that contribute to prompt $NO_X$ formation.

First stage combustion gases pass from the first chamber into the second chamber through an axial nozzle that projects into the second chamber. In the second chamber, secondary air is introduced axially through tubes located concentrically around the nozzle. The secondary air stream has a velocity sufficient to draw second stage furnace gases into an annular space between the first stage products emerging from the nozzle and the second stage air stream. The internal recirculation and premixing promotes uniform oxygen concentration and temperature in the secondary flame zone, helping to minimize $NO_X$ formation.

According to one aspect of the invention, a combustor for burning a mixture of a fuel and an oxidant includes a first combustion chamber that has an upstream end, a downstream end, and a longitudinal wall joining the ends, the wall having a longitudinally extending central axis. At least one gas inlet is arranged to introduce a flow of the oxidant to the upstream end to create a vortical flow from the upstream end to the downstream end. A fuel inlet is arranged to introduce the fuel to the upstream end to flow in a mixture with the vortical flow. There is at least one recirculation channel, each including a recirculation channel inlet downstream of the gas inlet and a recirculation channel outlet upstream of the recirculation channel inlet. The recirculation channel inlet is at a greater distance from the central axis than the recirculation channel outlet. The vortical flow causes a recirculated portion of the vortical flow to be extracted through the recirculation channel inlet and reintroduced through the recirculation channel outlet. The recirculation channel outlet is arranged to reintroduce at least part of the recirculated portion of the vortical flow into the combustion chamber at a position a distance from the central axis. An igniter upstream of the recirculation channel inlet ignites the fuel and oxidant mixture in the first combustion chamber. A combustion nozzle protruding into a second combustion chamber communicates the downstream end of the first combustion chamber with the second combustion chamber. A cooling jacket associated with the at least one recirculation channel extracts heat from the recirculated portion of the vortical flow. The cooling jacket includes an inlet and an outlet for flowing a coolant through the cooling jacket. A secondary air nozzle, which communicates secondary air to the second combustion chamber, is arranged to provide a flow of the secondary air in a substantially annular pattern from around and upstream of the combustion nozzle orifice and to allow combustion gases in the second combustion chamber to mix with the secondary air.

According to another aspect of the invention, a combustor for burning a mixture of a fuel and an oxidant gas includes a combustion chamber having an upstream end, a downstream end, and a longitudinal wall joining the ends, the downstream end including a combustion chamber outlet. The longitudinal wall can be substantially cylindrical. The oxidant gas can be selected from the group consisting of air, oxygen, oxygen enriched air, and oxygen depleted air. A gaseous fuel inlet is arranged to introduce a mixture of an oxidant gas and a gaseous fuel to the upstream end of the combustion chamber so as to create a vortical flow of the mixture moving towards the downstream end. An igniter at the upstream end of the combustion chamber ignites the mixture. The combustor also has a recirculation channel, which includes a recirculation channel inlet downstream of the fuel inlet and upstream from the combustion chamber outlet, and a recirculation channel outlet upstream of the recirculation channel inlet. The recirculation channel inlet is at a greater distance from a longitudinal central axis of the combustion chamber than the recirculation channel outlet. The vortical flow urges a recirculated portion of partially oxidized products of combustion to be extracted from the combustion chamber through the recirculation channel inlet, to pass through the recirculation channel and to be reintroduced to the combustion chamber through the recirculation channel outlet.

The combustor can include other features. A heat exchanger can be coupled to the at least one recirculation channel for removing heat from the partially oxidized products of combustion passing through the at least one recirculation channel. The heat exchanger may include a cooling jacket substantially surrounding the at least one recirculation channel and the combustion chamber. The cooling jacket includes a coolant inlet and a coolant outlet for flowing a coolant therethrough. The coolant may be air, or a liquid coolant, such as water. The combustor can further include an apparatus employing heat, wherein the coolant outlet communicates heated coolant to the apparatus employing heat.

The combustor can include a second combustion chamber that has an inlet communicating with the combustion chamber outlet to provide partially oxidized products of combustion to the second combustion chamber. The second combustion chamber can also have a secondary air inlet for providing secondary air to further oxidize the partially oxidized products of combustion in the second combustion chamber. When air is used as the coolant, the coolant outlet can communicate with the secondary air inlet to provide heated secondary air to the second combustion chamber.

The heat exchanger can include fins coupled to the recirculation tube. The fins may be coupled to an inside wall of the recirculation channel, or to an outside wall. The recirculation channel can include a plurality of parallel flow recirculation channels arrayed at angularly spaced locations with respect to the central axis, each having a respective recirculation channel inlet which opens into the combustion chamber wall and each communicating with the recirculation channel outlet. The recirculation channel outlet may be arranged to direct a flow of the recirculated portion of combustion gases into the combustion chamber in a direction substantially parallel with the central axis. The recirculation channel outlet may be arranged to preheat the mixture before the mixture is ignited.

The combustor can further include a fuel nozzle connected to a liquid fuel line for communicating a liquid fuel from outside the combustor to the combustion chamber. The fuel nozzle may be movable between an extended position arranged to direct an atomized flow of the liquid fuel into the vortical flow and a retracted position out of the vortical flow.

The combustor may have a fuel mixer communicating with the gaseous fuel inlet, wherein the mixer is adapted to create a substantially homogeneous mixture of the gaseous fuel and the oxidant.

According to yet another aspect of the invention, a combustor for burning a mixture of fuel and an oxidant gas includes a combustion chamber that has an upstream end, a downstream end, a longitudinal wall joining the ends, and a combustion chamber outlet at the downstream end. A fuel inlet is arranged to introduce a flow of the oxidant gas into the combustion chamber at the upstream end. At least one gas inlet is arranged to introduce a flow of the oxidant gas into the combustion chamber at the upstream end, creating a flow of the fuel and oxidant mixture from the upstream end to the downstream end. An igniter, located upstream of the at least one gas inlet, ignites the mixture in the combustion chamber. A recirculation channel inlet, downstream of the gas inlet and upstream of the combustion chamber outlet, is arranged to extract a portion of partially oxidized products of combustion from the combustion chamber. A recirculation channel outlet, upstream of the recirculation channel inlet, is arranged to reintroduce the portion of partially oxidized products of combustion to the combustion chamber off of a central axis thereof. A recirculation channel connects between the recirculation channel inlet and the recirculation channel outlet. The recirculation channel outlet can include a plurality of openings approximately centered on the central axis of the combustion chamber. The recirculation channel outlet may have a cross sectional area sufficient to pass the recirculated gas without creating a pressure drop greater than about a pressure drop caused by the recirculation channel.

The gas inlet can include a plurality of gas inlet openings in the cylindrical wall of the combustion chamber. These openings are arranged to cause the mixture and the partially oxidized products of combustion to vortically flow from the upstream end to the downstream end in the combustion chamber. The vortical flow causes a portion of the partially oxidized products of combustion to recirculate through the recirculation channel. The at least one gas inlet can include the fuel inlet, wherein the fuel includes a gaseous fuel. The combustor can include a mixer communicating with the at least one gas inlet, wherein the mixer is adapted to create a substantially homogeneous mixture of the gaseous fuel and the oxidant. The fuel inlet may also include a fuel nozzle connected to a fuel line for communicating a liquid fuel from outside the combustor to the combustion chamber.

According to still another aspect of the invention, a multiple-stage combustor includes an upstream combustion chamber, a downstream combustion chamber having an end wall, and a nozzle communicating partially oxidized products of combustion from the upstream combustion chamber to the downstream combustion chamber. The nozzle protrudes from the end wall into the downstream combustion chamber. The nozzle may be formed of a nozzle material capable of withstanding temperatures approximately equal to or greater than 1400° F. without significant damage. The nozzle may include a cooling mechanism. The cooling mechanism can include a coolant channel permitting a coolant fluid to pass therethrough.

The multiple-stage combustor can further include a secondary air inlet to the downstream combustion chamber, arranged to provide a flow of secondary air to the downstream combustion chamber in a substantially annular shaped flow pattern around the partially oxidized products of combustion exiting the combustion channel. The secondary air inlet can include a plurality of secondary air tubes opening into the downstream combustion chamber, wherein the secondary air tubes are arrayed around the nozzle in a substantially circular arrangement. The plurality of secondary air tubes may protrude at least about as deep into the downstream combustion chamber as does the nozzle.

In yet another aspect, the invention provides a multiple-stage combustor, having an upstream combustion chamber, a downstream combustion chamber having an end wall, a combustion channel communicating partially oxidized products of combustion from the upstream combustion chamber through the end wall into the downstream combustion chamber, and a secondary air inlet to the downstream combustion chamber. The secondary air inlet is structured and arranged to provide a flow of secondary air to the downstream combustion chamber in a substantially annular shaped flow pattern around the partially oxidized products of combustion exiting the combustion channel. The combustion channel may extend through a nozzle protruding from the end wall a distance into the downstream combustion chamber. In this embodiment, the secondary air inlet provides the annular shaped flow at a distance from the end wall being at least about as great as the distance that the nozzle protrudes from the end wall. The secondary air inlet may include a plurality of secondary air tubes extending into the downstream combustion chamber, the secondary air tubes being arrayed around the nozzle in a substantially circular arrangement. In another feature, the secondary air inlet provides a flow of secondary air sufficient to entrain gases from the downstream combustion chamber into a flow that passes between the secondary air inlet and the nozzle.

The combustor can further include a heat exchanger structured and arranged to remove heat from the upstream combustion chamber. This extracted heat can be used to preheat the secondary air prior to introducing the secondary air into the downstream combustion chamber.

The invention, in another aspect, provides a multi-stage combustor. A fuel mixing system is structured and arranged to provide a continuous flow of a fuel mixture that includes a gaseous fuel and an oxidant with about 45% to about 90% stoichiometric oxygen. The fuel mixing, which is adapted to provide a substantially homogeneous fuel mixture, system includes a fuel inlet, an oxidant inlet, and a fuel mixture outlet. A first combustion chamber partially oxidizes the fuel mixture and produces partially oxidized products of combustion. The first combustion chamber includes a fuel mixture inlet communicating with the fuel mixture outlet, and a fuel igniter. A second combustion chamber communicates with the first combustion chamber for further oxidizing the partially oxidized products of combustion. The second combustion chamber includes a secondary oxidant inlet arranged to introduce into the second combustion chamber additional oxidant sufficient to completely oxidize the partially oxidized products of combustion.

The first combustion chamber includes a substantially cylindrical shaped wall extending between an upstream end and a downstream end, the downstream end including an outlet for the partially oxidized products of combustion communicating with the second combustion chamber. The fuel mixture inlet has a plurality of fuel mixture inlet apertures near the upstream end of the cylindrical wall. the apertures are structured and arranged to provide a flow of the fuel mixture into the first combustion chamber with sufficient velocity tangential to the cylindrical wall to create a vortical flow of the fuel mixture within the first combustion chamber. At least one recirculation channel recirculates partially oxidized products of combustion from the downstream end of the first combustion chamber to the up stream end of the first combustion chamber. Each recirculation channel includes a recirculation channel inlet downstream of the fuel mixture inlet and a recirculation channel outlet upstream of the recirculation channel inlet. The recirculation channel inlet is at a greater radial distance from a central axis of the first combustion chamber than the recirculation channel outlet. The vortical flow causes a recirculated portion of the vortical flow to flow into the recirculation channel inlet and to flow out of the recirculation channel outlet. The at least one recirculation channel may include a plurality of recirculation channels, the recirculation channel inlets being circumferentially spaced in the cylindrical wall near the downstream end of the first combustion chamber.

The multi-stage combustor can further include a combustion channel extending between a downstream end wall of the first combustion chamber to an upstream end wall of the second combustion chamber. The secondary oxidant inlet provides a secondary oxidant flow into the second combustion chamber that substantially surrounds and is substantially parallel with a flow of partially oxidized products of combustion flowing out of the combustion channel. The combustion channel can extend through a nozzle projecting into the second combustion chamber from the upstream end wall of the second combustion chamber, and the secondary oxidant inlet can include a plurality of secondary oxidant tubes extending into the second combustion chamber around the nozzle.

The mixing system can further include a mixer adapted to provide a fuel mixture including the oxidant and one of a liquid fuel and a fluidized solid particulate fuel. The mixer may have an outlet located approximately centrally between the plurality of fuel mixture inlet apertures.

In still another aspect, the invention provides an apparatus for converting a single stage burner into a two stage burner. The apparatus includes a first stage burner, including a substantially cylindrical combustion chamber, a fuel inlet system introducing a mixture of a fuel and less than stoichiometric oxygen into an upstream end of the combustion chamber and causing the mixture to flow vortically towards a downstream end of the combustion chamber, an igniter near the upstream end for igniting the mixture, at least one recirculation channel recirculating partially oxidized products of combustion from the downstream end to the upstream end, and a combustion product outlet at the downstream end. A flange assembly is adapted to couple between the first stage burner and a combustion chamber of the single stage burner. The flange assembly includes a central nozzle communicating a flow of partially oxidized products of combustion from the combustion product outlet to the combustion chamber of the single stage burner, and a secondary air passage communicating secondary air into the combustion chamber of the single stage burner. The secondary air passage is arranged to provide a flow of secondary air that substantially surrounds the flow of partially oxidized products of combustion from the central nozzle.

The invention also provides a method of reducing $NO_X$ emissions while combusting a fuel. The method includes forming a mixture of the fuel and about 45% to about 90% stoichiometric oxygen, generating a vortical flow of the mixture in a first combustion chamber from an upstream end to a downstream end of the combustion chamber, igniting the vortically flowing mixture to form partially oxidized products of combustion, recirculating a portion of the partially oxidized products of combustion from the upstream end to the downstream end, mixing the recirculated partially oxidized products of combustion with additional mixture in the vortical flow, communicating a second portion of the partially oxidized products of combustion through an outlet at the downstream end into a second combustion chamber, and further oxidizing the second portion of the partially oxidized products of combustion in the second combustion chamber. The last step can include providing a flow of secondary air into the second combustion chamber that substantially surrounds the second portion of the partially oxidized products of combustion communicated into the second combustion chamber, and inducing a flow of flue gases in the. second combustion to mix with and cool the second portion of the partially oxidized products of combustion and secondary air. Communicating the second portion of the partially oxidized products of combustion into the second combustion chamber may include flowing the second portion of the partially oxidized products of combustion into the second combustion chamber through a nozzle protruding into the second combustion chamber. Forming the mixture of the fuel oxygen can include forming a substantially homogenous mixture.

The invention provides a gaseous fuel burner system capable of meeting the LAER standards for boilers and process heaters in the size range of about 3–200 MMBtu/hr, without resorting to costly post-processing of exhaust gases. By operating the first stage at optimum conditions, a gaseous fuel, such as natural gas, can be reformed to species that will not contribute to the formation of prompt $NO_X$. Thermal $NO_X$ production is also reduced by reducing the is formation of hot spots in the first stage, and by reducing the secondary flame temperature in the second stage. The VIStA system promotes very stable combustion over a wide range of stoichiometry and firing rates.

Another advantage of the invention is that it is suited to retrofit existing single-stage burners. It therefore can extend the life of older systems by bringing them up to present emission standards at a reasonable cost.

In addition to providing a burner that produces extremely low emissions of $NO_X$, the invention simultaneously provides a burner that produces very low CO emissions.

BRIEF DESCRIPTION OF THE DRAWING

FIGS. 10A and 10B have different arrangements for introducing the secondary air into the second combustion chamber.

FIG. 15 is a longitudinal section view of the nozzle assembly. FIG. 16 is a section view through line 16—16 of FIG. 15. FIGS. 17 and 18 are views of opposite sides of an inner cylindrical shell in the nozzle assembly.

DETAILED DESCRIPTION OF THE INVENTION

The vortex inertial staged air (VIStA) combustor is designed to provide ultra-low $NO_X$ production of less than about 20 ppmvd with CO emissions of less than about 50 ppmvd, both at 3% $O_2$, while maintaining high efficiency, productivity, and ease of operation and maintenance. When optimized with a natural gas fuel, the VIStA combustor can operate with $NO_X$ emissions as low as 4–9 ppmvd. Both prompt and thermal $NO_X$ production is addressed. Prompt $NO_X$ production is reduced by partially reforming the fuel in a first combustion stage to CO and $H_2$. This is achieved in the first stage by operating with a fuel rich mixture, and by recirculating partially oxidized combustion products, with control over stoichiometry, recirculation rate and residence time (the average time that a fuel molecule stays in the first stage, whether oxidized or unoxidized). Thermal $NO_X$ production is reduced in the first stage by reducing the occurrence of high temperature combustion gas regions. This is achieved by providing the first stage burner with a thoroughly pre-mixed fuel/oxidant composition. In a second stage combustor thermal $NO_X$ production is controlled by inducing a large flow of flue gas recirculation in the second stage combustion zone to minimize the ultimate temperature of the flame. One or both of the first and second stage burners can be cooled to further reduce the combustion temperature and to improve the recirculation efficiency. Both of these factors tend to reduce production of $NO_X$.

Figure 1:
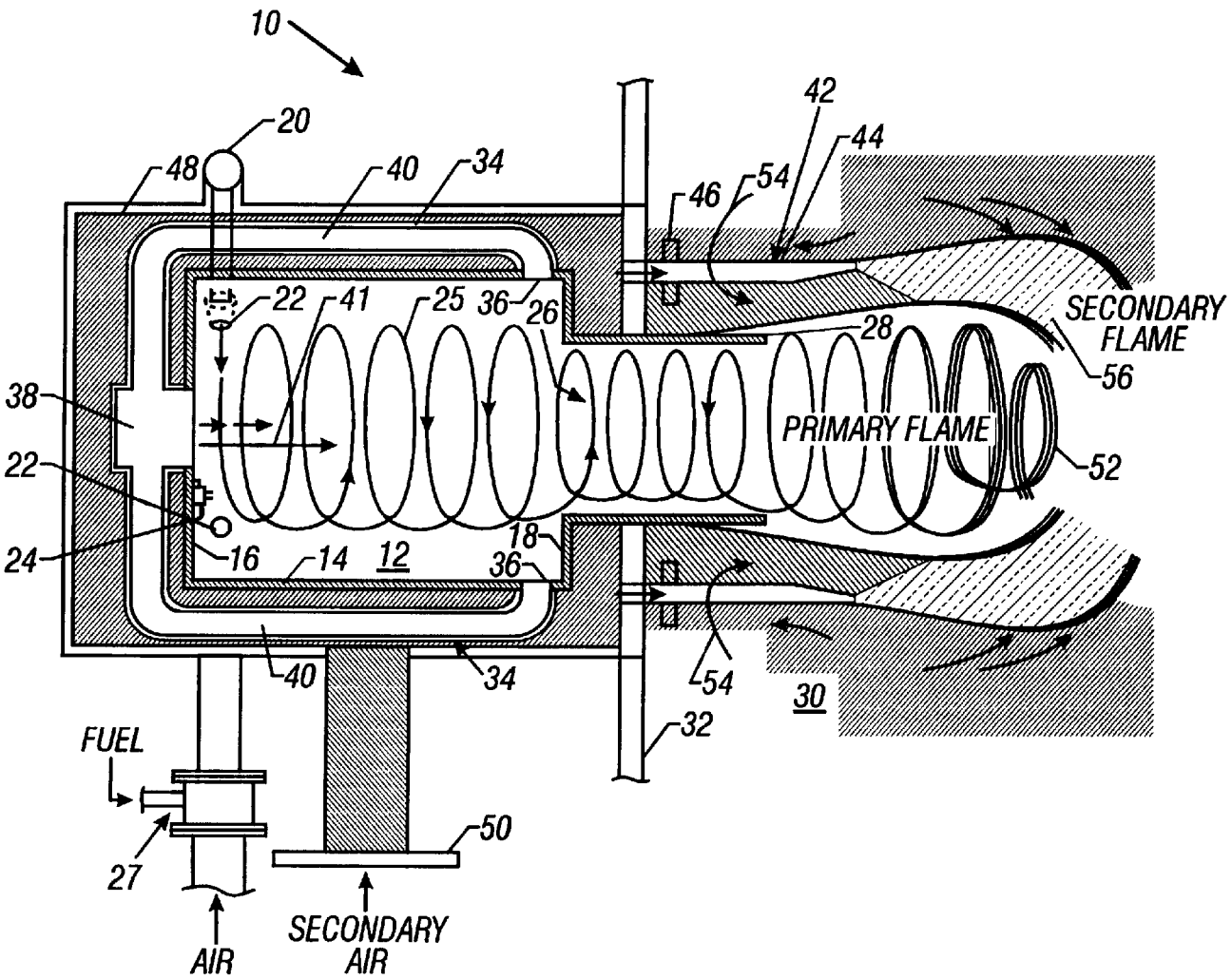
FIG. 1 is a diagrammatic longitudinal cross section of a multistage burner illustrating features of the invention.

Referring to FIG. 1, a VIStA combustor 10 that illustrates the above-outlined concepts includes two combustion stages. A first combustion chamber 12 includes a substantially cylindrical side wall 14, which is made of a refractory material or a ceramic, connecting between an upstream end 16 and a downstream end 18. A mixture of air and a fluid or fluidized fuel, such as, for example, natural gas, passes through a gas ring header 20, which then distributes the mixture through a plurality of circumferentially spaced fuel inlets 22 in side wall 14 near upstream end 16. Fuel inlets 20 are structured and arranged to provide a high velocity, tangential flow of the fuel mixture into first chamber 12. The tangential flow velocity can be in a range between about 50 ft/s and about 200 ft/s, which provides acceptable levels of $NO_X$ with an acceptable pressure drop. More preferably, the tangential flow velocity is in a range between about 100 ft/s and about 150 ft/s. The tangential flow is ignited by a continuous spark igniter 24, or alternatively by a continuous pilot light with a continuous spark igniter, and flows vortically from upstream end 16 to downstream end 18 as it burns. Upon reaching steady state temperature, igniter 24 may be turned off to help reduce $NO_X$ production from igniter 24. The vortical flow is indicated by arrows 25 in FIG. 1.

The fuel is mixed with from about 45% to about 90% stoichiometric air. More preferably, the fuel is mixed with from about 55% to about 65% stoichiometric air, and most preferably the fuel is mixed with about 60% stoichiometric air. Because of the fuel rich mix, the fuel only partially oxidizes in the first stage. When natural gas is used as the fuel, it is reformed to chemicals that do not contribute to $NO_X$ formation. The uniformity of the fuel mixture is very important in eliminating high temperature combustion regions in first combustion chamber 12 that contribute to thermal $NO_X$ formation. A mixer 27, which can be, for example, a turbulator, is employed to provide a uniform air/fuel mixture.

Some of the partially oxidized combustion products flow out of first combustion chamber 12 through a central outlet 26 in downstream end 18, and then through a nozzle 28 that protrudes through an end wall 32 into a second combustion chamber 30. Second combustion chamber can be an existing single-stage furnace, being modified as described herein.

Another portion of the partially oxidized combustion products in vortical flow 25 is recirculated through one or more recirculation passages 34. Recirculating the partially oxidized combustion products further provides high levels of mixing and temperature uniformity. Recirculation passages 34 each include a recirculation inlet 36 in side wall 14 near downstream end 18, a recirculation outlet 38 near upstream end 16, and a recirculation channel 40 connecting between each recirculation inlet 36 and recirculation outlet 28. Recirculation outlets 38 join to provide a substantially axially directed flow of recirculated, partially oxidized combustion products into first combustion chamber 12. The direction of the recirculation flow into first combustion chamber is indicated with arrows 41. As will be described in detail below, vortical flow 25 provides a pressure drop between the recirculation inlets 36 and the recirculation outlets 38 that causes partially oxidized combustion products to flow through the recirculation passages. To minimize $NO_X$ production, a geometry capable of providing a cold gas recirculation rate of more than about 50% is desirable, which, at operating temperatures of first combustion chamber, would provide a recirculation rate of about 20%–50%.

As partially oxidized combustion products flow through nozzle 28, they continue flowing vortically. A ring of secondary air inlets 42 concentrically surrounds nozzle 28. Each secondary-air inlet 42 can include a tube 44 that extends into second combustion chamber at least about as far as does nozzle 28. Tubes 44 can be made of a durable metal, such as stainless steel. In the embodiment depicted in FIG. 1, tubes 44 are connected to fittings 46, which communicate through end wall 32 with the inside of a secondary air jacket 48 that substantially surrounds first combustion chamber 12 and recirculation channels 40. Jacket 48 includes a jacket inlet 50 through which ambient air enters. As the air passes through jacket 48, the air extracts heat from the recirculation channels 40, thereby reducing the temperature of the partially oxidized combustion products being reintroduced into first combustion chamber 12.

An axial flow of secondary air from tubes 44 surrounds a primary flame 52 that comes out from nozzle 28. The secondary air flow entrains combustion gases, including partially oxidized combustion products, from second combustion chamber 30. Sufficient combustion chamber gases, as indicated by arrows 54, are entrained into an annular space between first stage combustion products flowing out of nozzle 28 and the secondary air stream so as to lower both the temperature and the oxygen concentration in a secondary flame zone 56, thereby reducing thermal $NO_X$ formation. The secondary air flow combined with the primary air flow into first stage combustor 12 should provide a total of about 105% to about 150% stoichiometric air.

Figure 2:
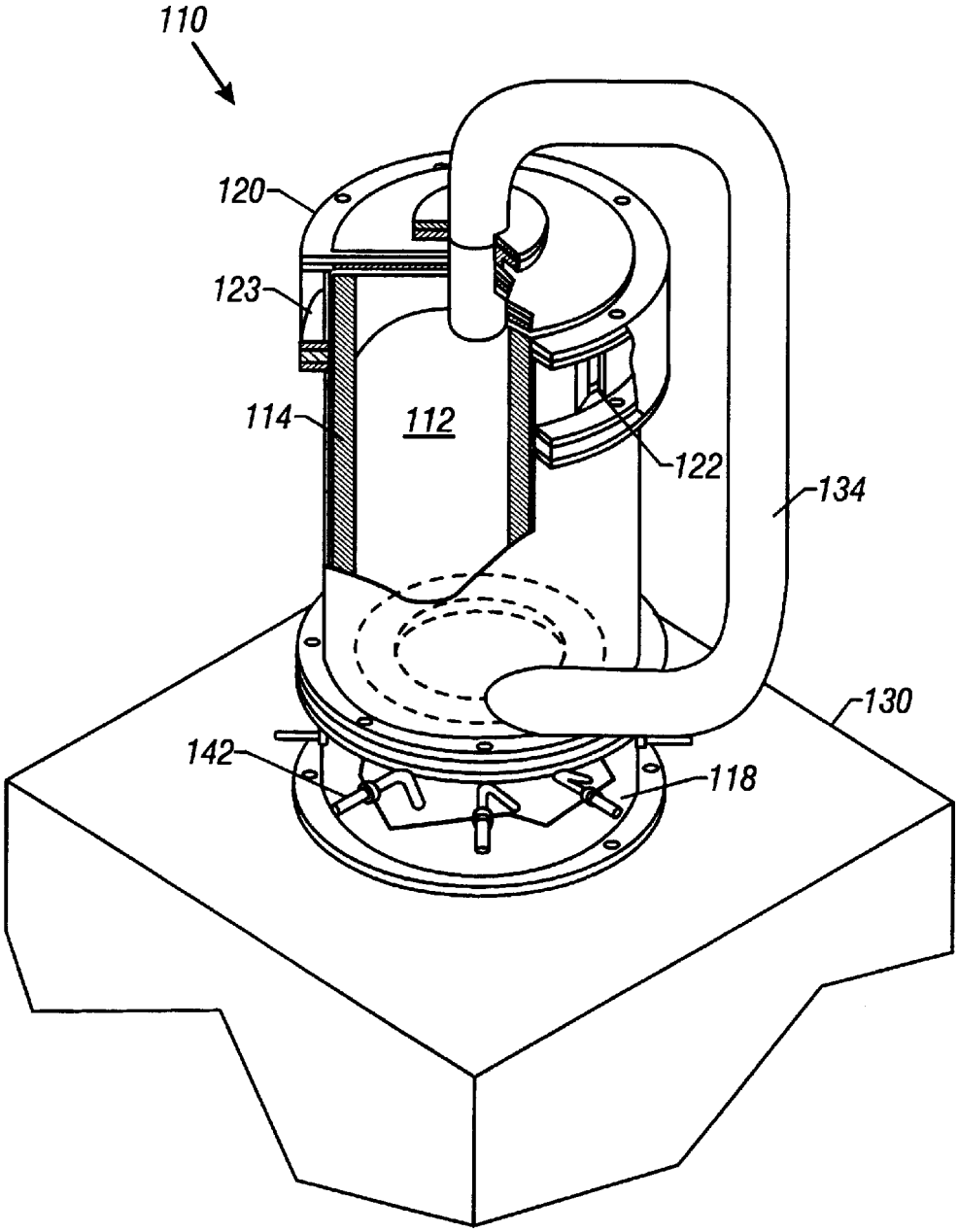
FIG. 2 is a partially broken away perspective view of a 0.3 MMBtu/hr test burner according to the invention.
Figure 3:
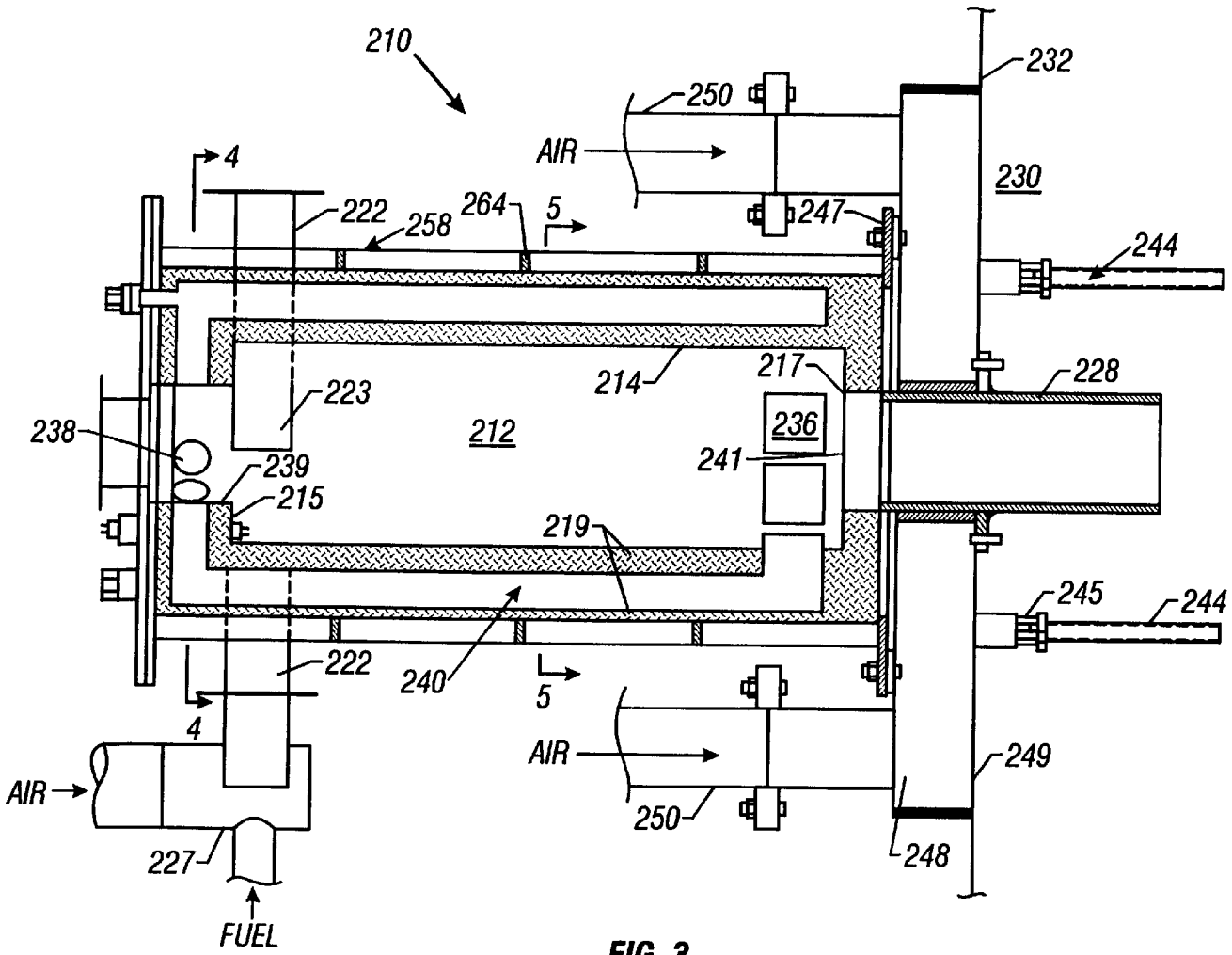
FIG. 3 is a longitudinal cross section of 3 MMBtu/hr test burner according to the invention.
Figure 4:
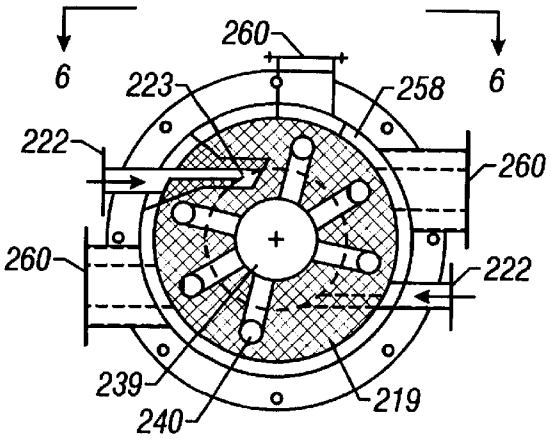
FIG. 4 is a section through line 4—4 of FIG. 3.
Figure 5:
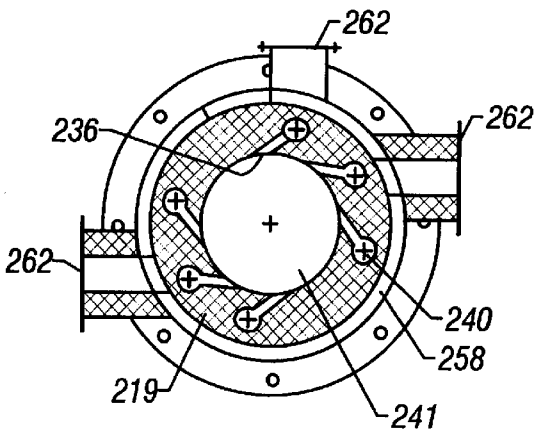
FIG. 5 is a section through line 5—5 of FIG. 3.
Figure 6:
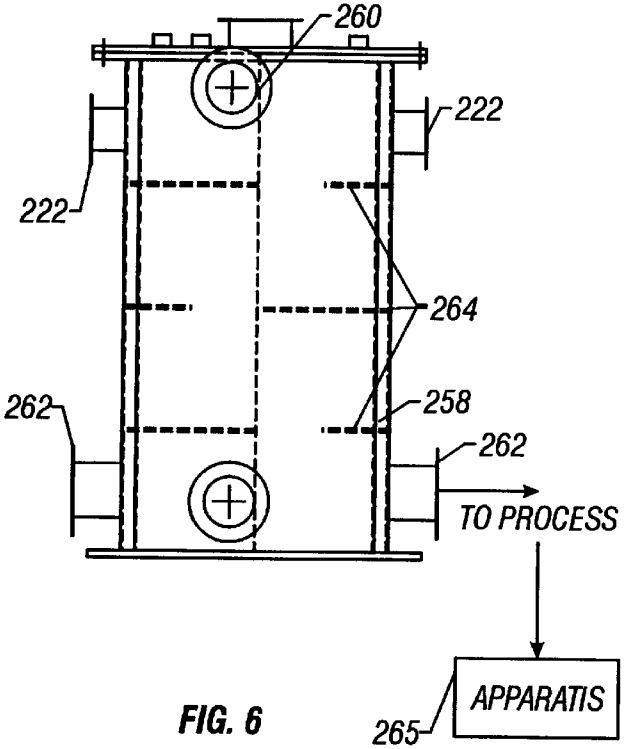
FIG. 6 is a side view along line 6—6 of FIG. 4

Referring now to FIG. 2, a prototype burner 110 used. for testing some of the concepts of the invention has a thermal capacity of about 0.2 MMBTU/hr. Burner 110 includes a first combustion chamber 112 having a cylindrical refractory wall 114, a fuel inlet header 120 with a plurality of fuel inlets 122, and a single recirculation channel 134. Fuel inlets 122 are rectangular-shaped slots coming off a common annular channel 123. First combustion chamber has an internal diameter of about 8.5 inches, an overall length of about 19 inches and a recirculation line inner diameter of about 2.85 inches. At a downstream end a connecting flange 118 connects to a second combustion chamber 130. Secondary air inlets 142 pass through connecting flange 118 to second combustion chamber 130. There is no secondary air jacket in this embodiment—secondary air comes directly from ambient or from a controlled pressure and temperature source of air.

Another VIStA combustor 210 with a capacity of about MMBTU/hr is shown in FIGS. 3–6. A first combustion chamber 212 has a side wall 214 with an inside diameter of about 10.375 inches and an internal length of 30.375 inches between upstream and downstream end walls 215, 217. Chamber's 212 overall length is about 37.25 inches. A fuel/air mixer 227 provides a natural gas and air fuel mixture to two fuel inlets 222 (not shown in FIG. 6), each having a rectangular-shaped aperture 223.

Six recirculation channels 240 connect between respective recirculation inlets 236 and outlets 238. Recirculation outlets are entirely within refractory material 219, which forms walls 214, 215 and 217. Recirculation outlets 238 face into an axial channel 239 that, like central outlet, has a diameter of about six inches.

Downstream end wall 217 includes a central outlet 241 having a six inch diameter. Central outlet 241 connects with a nozzle 228 that extends into a second combustion chamber 230 by about 10 inches. Nozzle has an inner diameter of about 5.5 inches, and is made of a high temperature stainless steel material. A substantially annular shaped secondary air manifold 248 attaches to an outside wall 232 of second combustion chamber 230 over an opening in wall 232 about 3 ft in diameter. A flange 247 at the downstream end of the first combustion chamber 212 attaches to the other side of secondary air manifold 248, and nozzle 228 passes through a central opening of manifold 248 and attaches to a wall 249 of manifold 248 that faces second combustion chamber 230. Two tubes 250 supply secondary air to manifold 248. Fourteen secondary air tubes 244 extending from respective fittings 245 in manifold 248 concentrically surround nozzle 228. Secondary air tubes 244, which are made of a high temperature stainless steel material, extend about 3.5 inches past nozzle 228. The secondary air tubes 244 can be configured in other arrangements to extend into second combustion chamber 230 only as far as does nozzle 228.

Substantially surrounding refractory material 219 is an annular coolant jacket 258. Coolant jacket 258 includes coolant inlets 260 and outlets 262 (not shown in FIG. 3) at upstream and downstream ends of first combustor 112. Coolant jacket 258 also includes internal baffles 264. $NO_X$ production is reduced significantly by reducing the temperature of chamber 212 to a range of about 1400° F. to about 2200° F. with a coolant jacket. Air or water can be employed as coolants in coolant jacket 258. Although not shown in the drawings, another coolant jacket can also be employed to cool second combustion chamber 230. Moreover, the heated coolant flowing out of outlets 262 can supply process heat to an apparatus 265 that requires process heat.

The amount of recirculation in the first stage is dependent on the radial pressure distribution across the reactor, which is dependent on gas velocity, gas density and reactor geometry. the pressure distribution can be determined from Euler's equation:

$$dP/dr=\rho V_t^2/r, \quad \text{(Eq. 1)}$$

where $V_t$ is the tangential velocity, r is the distance from the reactor centerline, P is the gas pressure, and ρ is the gas density. The tangential velocity in a vortical flow field can be described by:

$$V_t/V_{in}=(1-n)^{1/2}[r_0/r-n(r_0/r-r/r_0)], \quad \text{(Eq. 2)}$$

where $V_{in}$ is the inlet velocity, n is a constant between 0 and 1, and $r_0$ is the radius of the reactor wall.

Based on experimental data n is empirically related to the inlet area and the combustor radius:

$$n=1-1.4[(A_i^{1/2})/r_0]^{0.9}, \quad \text{(Eq. 3)}$$

where $A_i$ is the inlet area. Integrating the first equation with the velocity distribution provided by the second and third equations yields the radial pressure distribution:

$$\Delta P = \rho V_{in}^2 / 2(1-n)\{n^2[1-0.36(r_{out}/r_o)^2] + (1-n)^2[2.78(r_o/r_{out})^2 - 1] + 4n(1-n)\ln[1.67(r_o/r_{out})]\}, \quad \text{(Eq. 4)}$$

where $r_{out}$ is the radius of the outlet partition opening. For typical inlet velocities and reactor geometries, the pressure difference between the centerline of the combustion chamber and the wall becomes significant with inlet velocities of more than about 75–100 ft/s.

The above analysis shows that there are several parameters that can be adjusted to improve the performance and operation of the burner. These include the size of the recirculation passages, the fuel inlet cross-sectional area, and the control of the fuel inlet gas velocity.

In the model illustrated in FIGS. 3–6, the recirculation passage is fabricated by forming six 1.875 inch ID tubes into the combustor wall refractory. Measurements-taken while flowing cold air, rather than a fuel mixture, through the fuel inlets have shown that these passages return about 60% of the fuel inlet cold air flow. Calculations indicate that this recirculation rate declines as the temperature of the combustion zone increases, as would happen in an operating burner. The recirculation rate can be increased by increasing the total area of the recirculation passage and by designing the recirculation passage inlets and outlets to minimize pressure drops.

Figure 7:
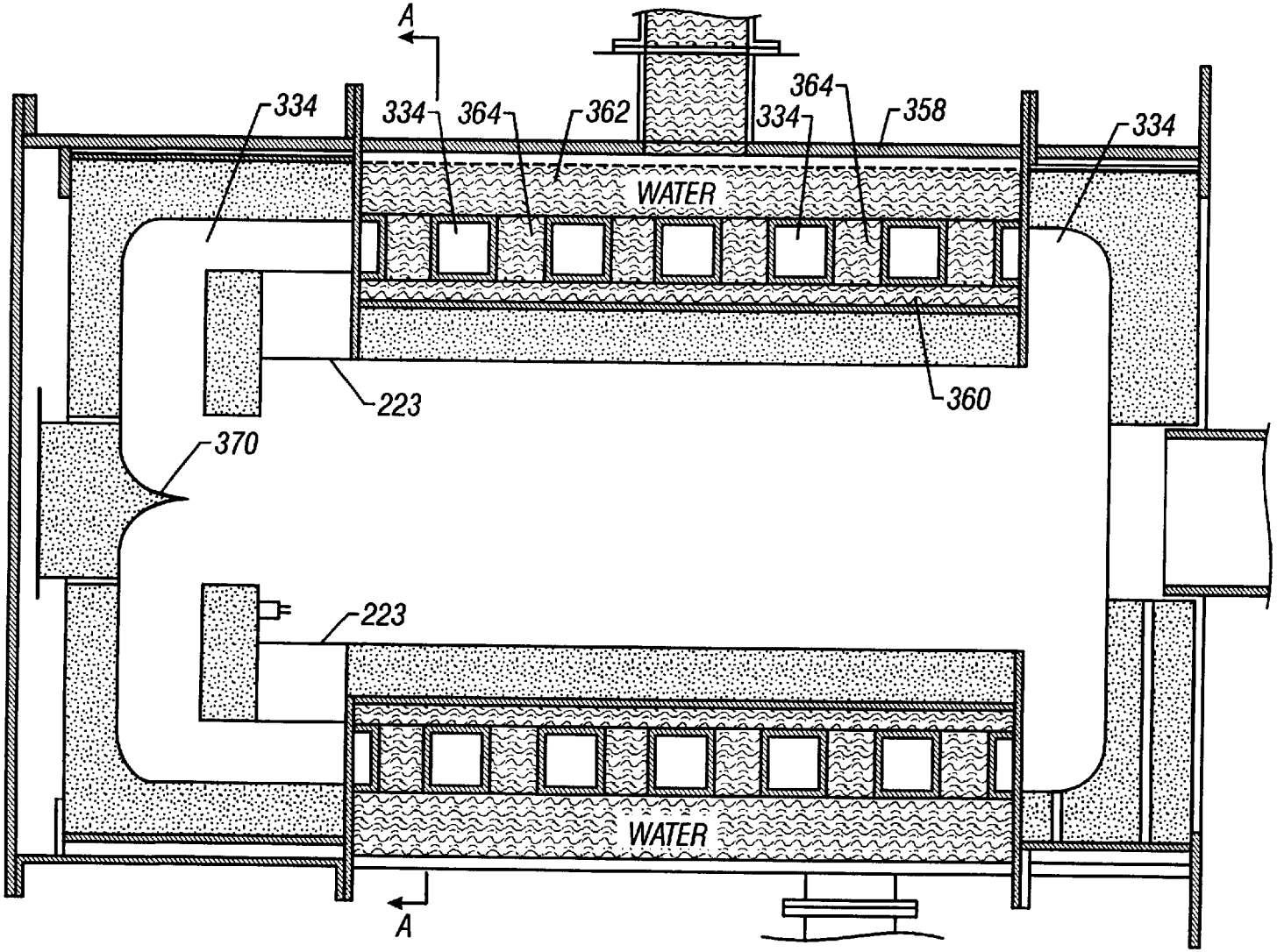
FIG. 7 is a schematic longitudinal section view of a first stage combustion chamber illustrating an alternative embodiment of according to another embodiment of the invention.
Figure 8:
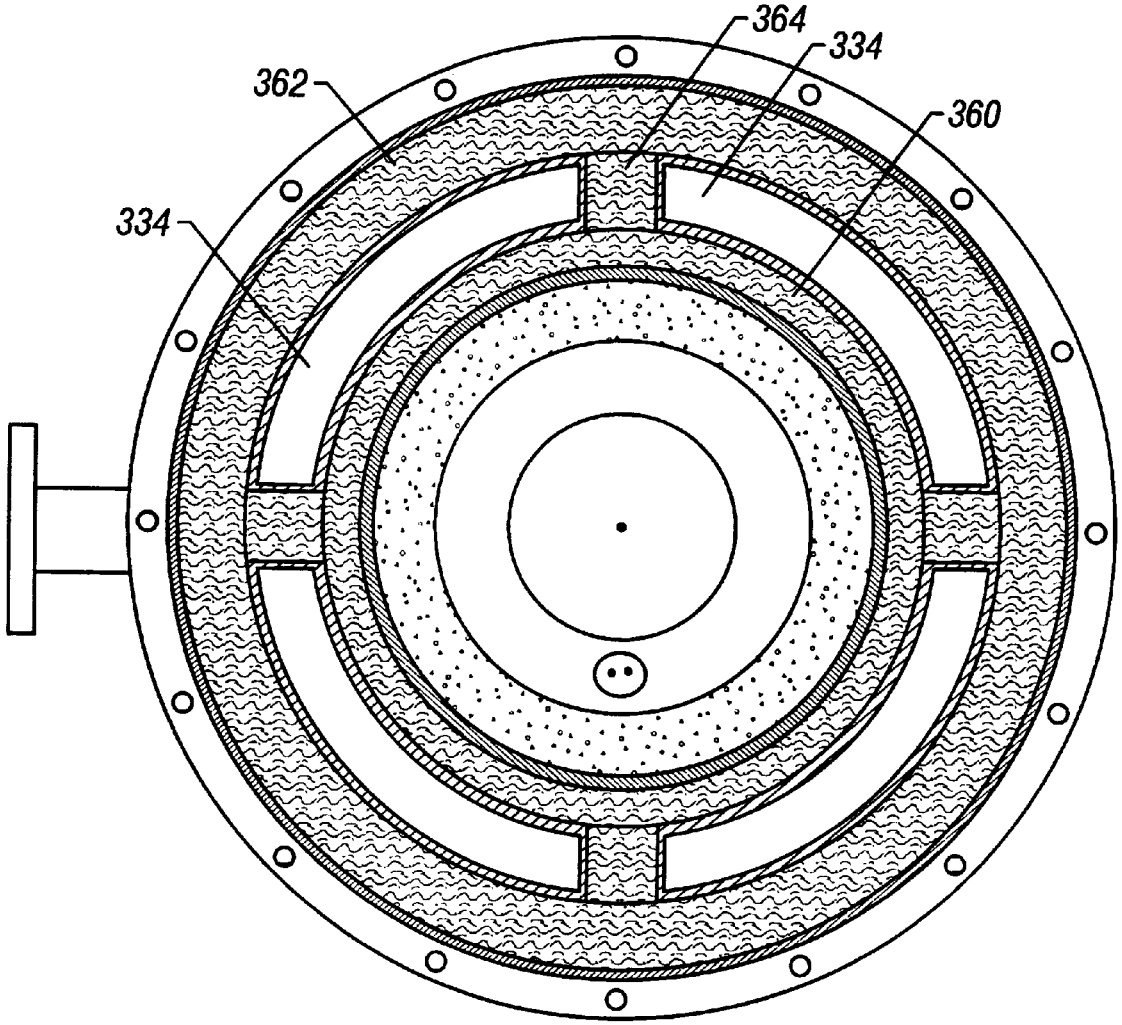
FIG. 8 is a section view through line 8—8 of FIG. 7.

In one embodiment, illustrated in FIGS. 7 and 8, an annular section of a recirculation passage is formed as a substantially annular passage 334 within a coolant jacket 358. Coolant jacket 358 includes an annular inner water jacket 360 and an annular outer water jacket 362. Inner and outer water jackets 360, 362 are connected by spaced passages 364.

Rounding the corners in turns of the recirculation passage inlets and outlets helps to reduce pressure drops in the recirculation passages. A rounding plug 370, as illustrated in FIG. 7, can be employed in the final recirculation return to minimize the pressure drop created by having the recirculation gases impinge on gases coming from opposing tubes.

Figure 9:
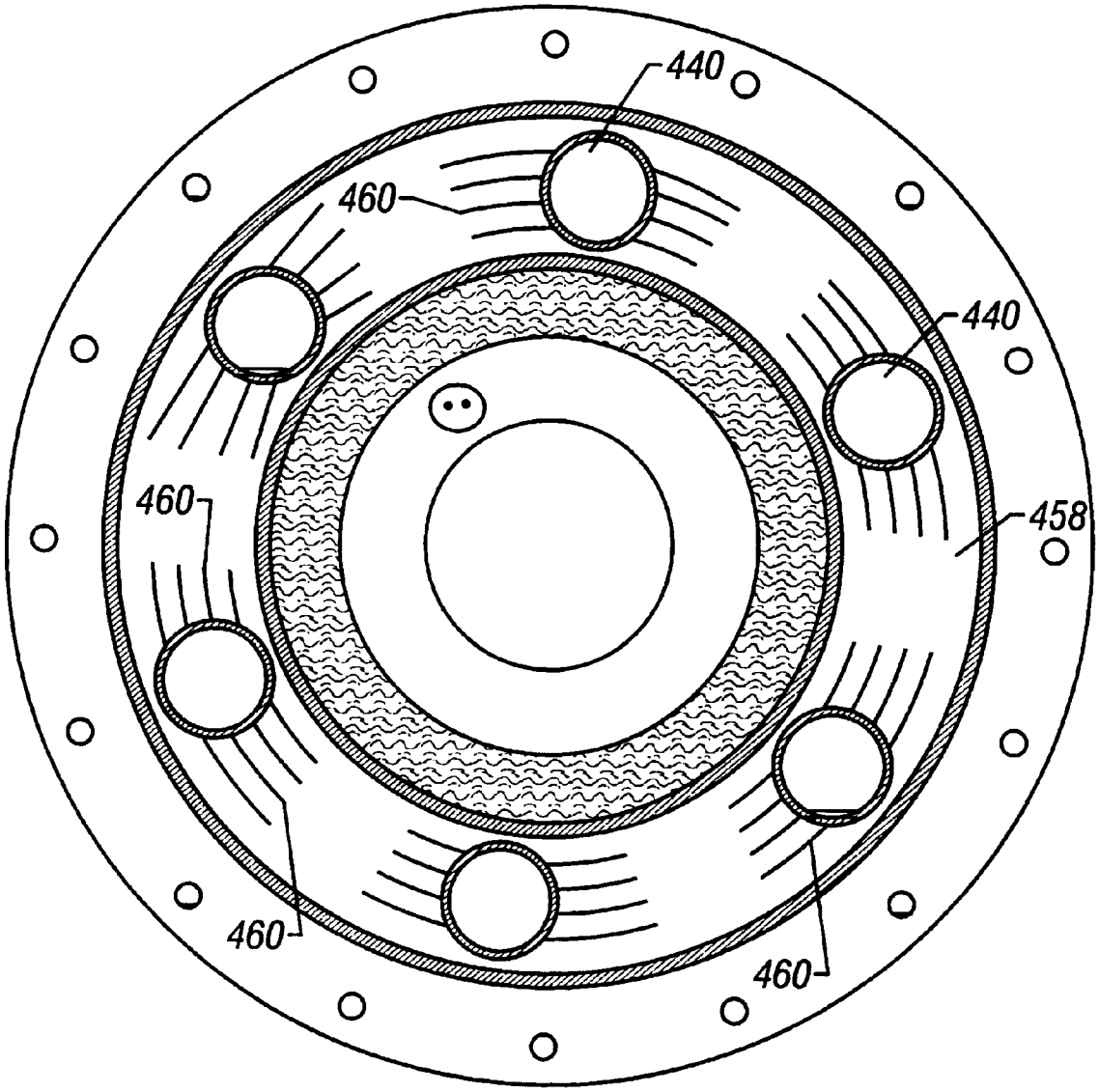
FIG. 9 is a section view through a first stage combustion chamber illustrating yet another embodiment of the invention.

In another embodiment, illustrated in FIG. 9, the recirculation passage includes six tubes 440 passing through a water cooled annulus 458. Each of recirculation tubes 44 includes cooling fins 460 to aid in heat exchange with coolant water circulating in annulus 458. The heated water flowing out of annulus 458 can be used, for example, as preheated water for a boiler or steam generator associated with the VIStA combustor, or as a heated water supply for an apparatus that requires heated process water.

Figure 10A:
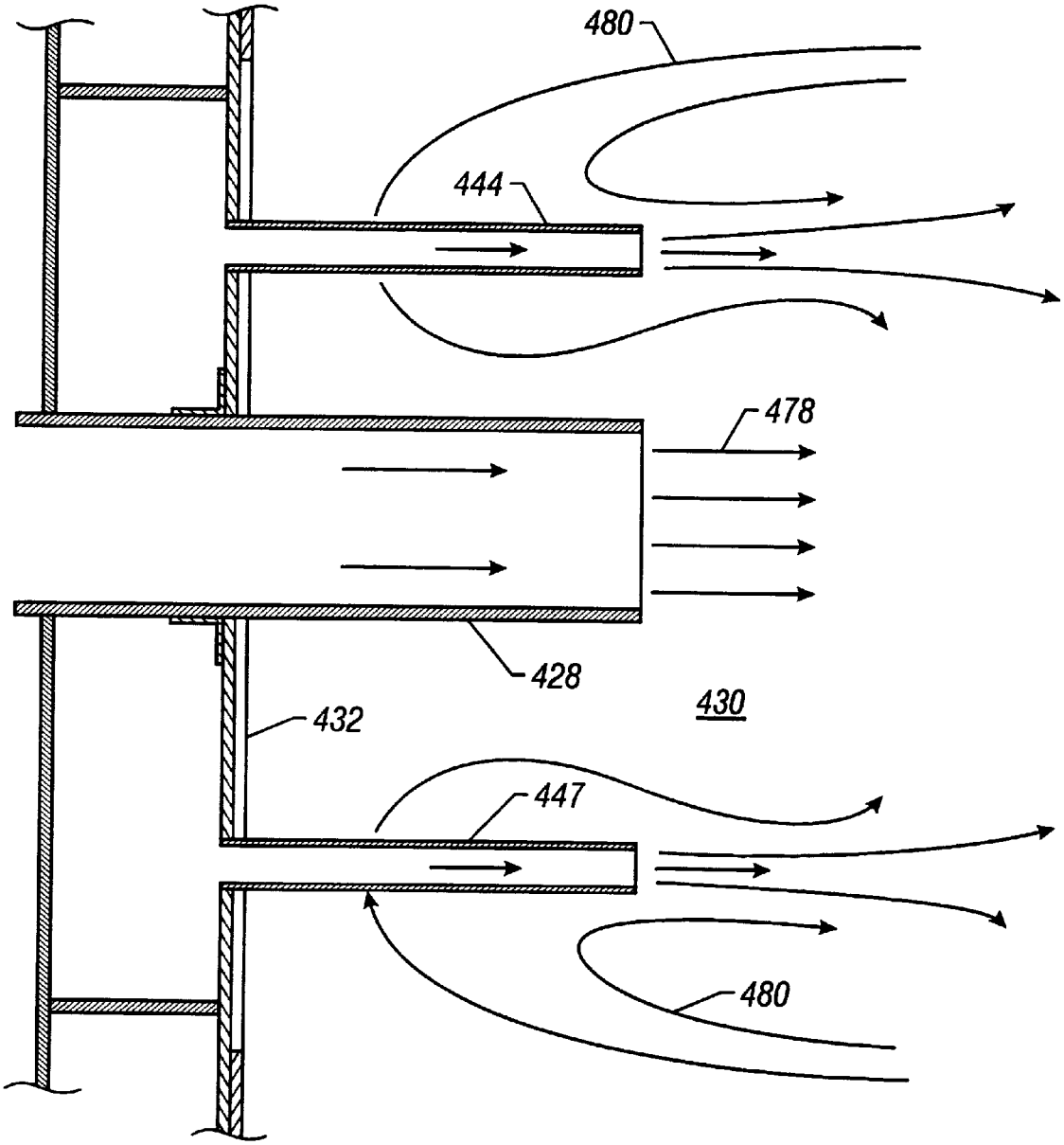
FIGS. 10A and 10B are similar sectional views of an end wall of a second stage combustion chamber showing secondary air entraining furnace gases around a nozzle.

Annulus 458 could be modified to use air instead of water as a coolant. That coolant air will typically be used as secondary air in the second stage combustor after being heated. The heat carried by the secondary air will be dissipated by furnace gases 480 that flow alongside the secondary air inlet tubes 444, as shown in the flow pattern in FIG. 10A. Furnace gases 480 carry this heat to the walls 432 of second stage combustion chamber 430 where it is removed. In the embodiment illustrated in FIG. 10A there are eight secondary air inlet tubes 444 circumferentially arrayed around nozzle 428, however, only two are shown to simplify the drawing. A greater or lesser number of secondary air inlet tubes 444 can be employed in other embodiments to provide a flow of secondary air that substantially surrounds the primary flame 478 exiting from nozzle 428.

Figure 10B:
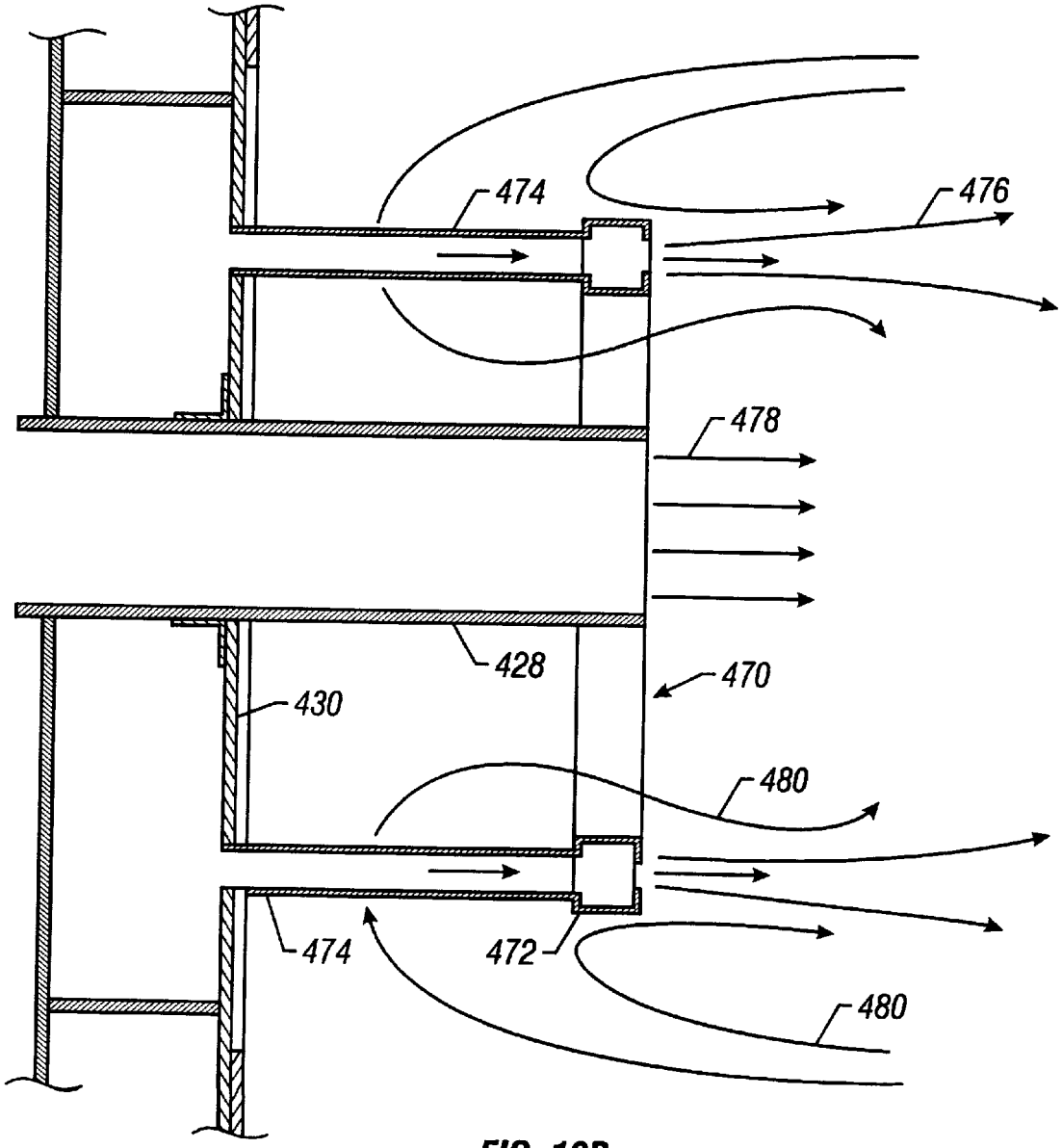

Another embodiment of a secondary air inlet 470, shown in FIG. 10B, includes an annular secondary air nozzle 472 combining a flow of secondary air from eight secondary air tubes 474 (only two shown). Nozzle 472 discharges an annular secondary air jet 476 around nozzle 428 and around partially oxidized products of combustion 478 coming out of nozzle 428. Furnace gases 480 can flow in between secondary air tubes 474, around annular nozzle 472, and along side nozzle 428 in a flow pattern similar to that depicted in FIG. 10A. Although eight secondary air tubes 474 are shown in FIG. 10B, as few as one or more than eight secondary air tubes 474 can be employed to connect to annular nozzle 472. Other arrangements can be employed to cause furnace gases 480 to flow substantially in the same direction as and between the flow of partially oxidized products of combustion 478 and annular secondary air jet 476.

Figure 11:
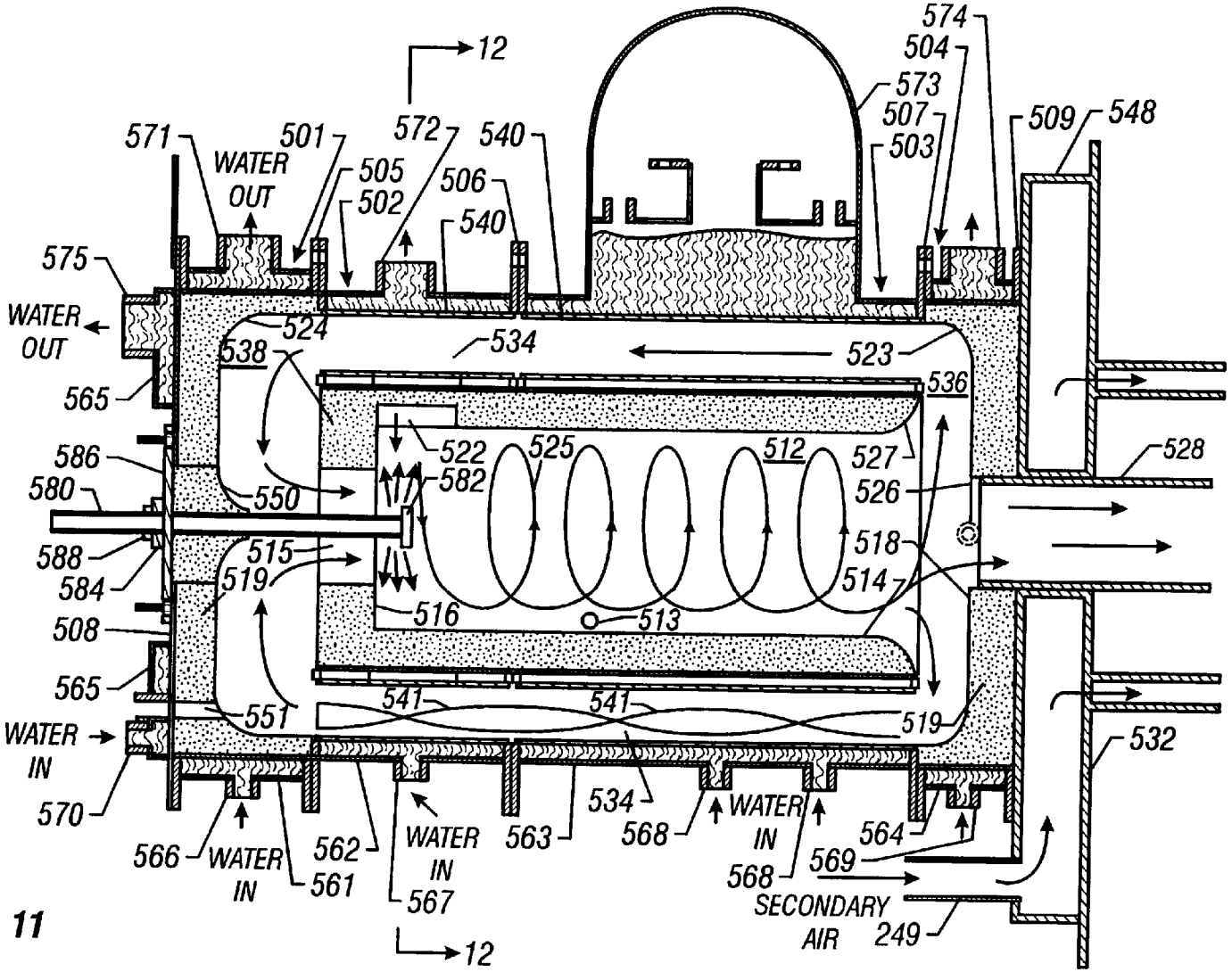
FIG. 11 longitudinal section view of another embodiment of a first stage burner.
Figure 12:
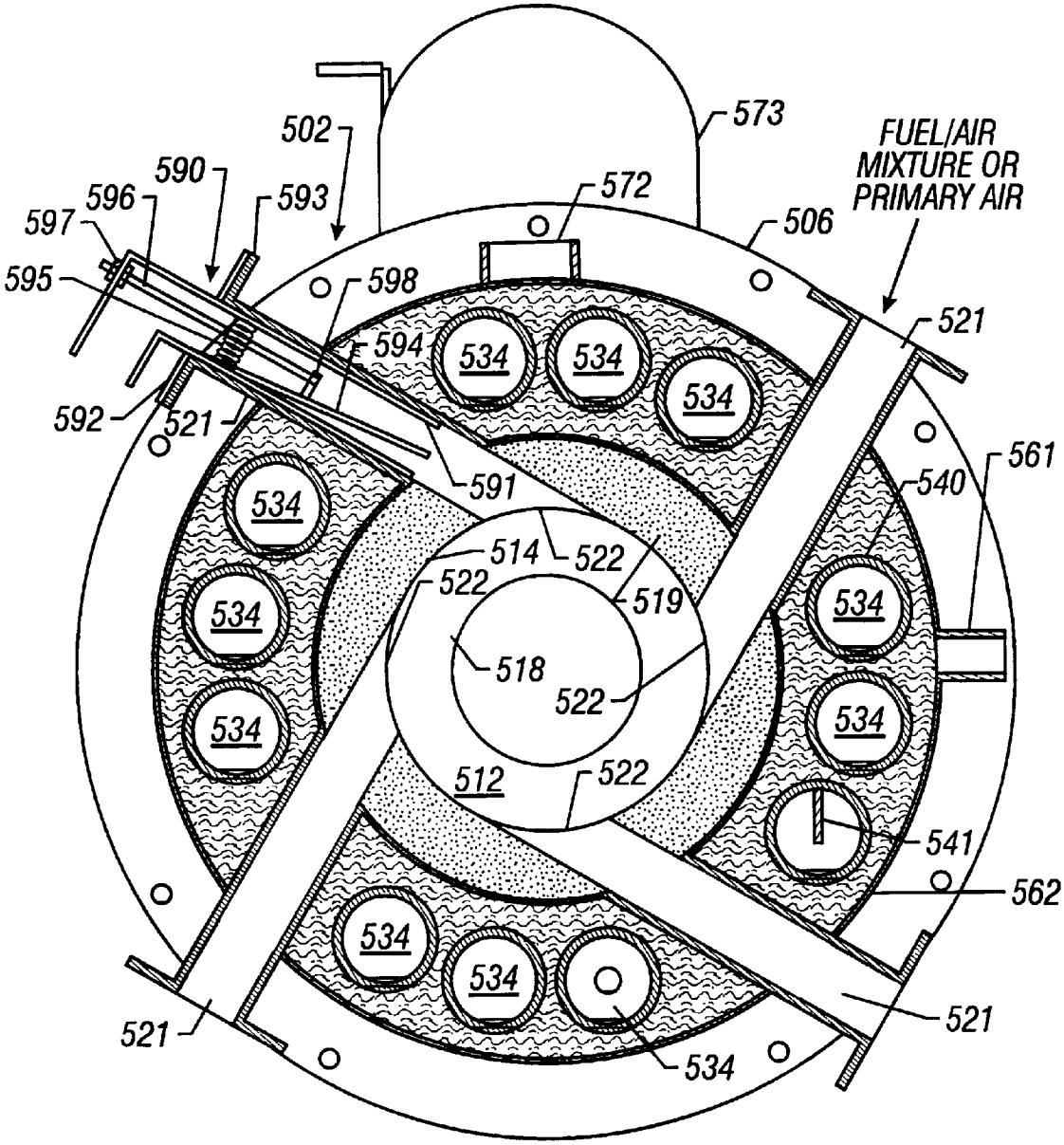
FIG. 12 is a section view through line 12—12 of FIG. 11 .

As mentioned above, the VIStA combustor can be adapted to burn a liquid fuel, such as fuel oil or a powdered coal slurry. Referring now to FIGS. 11 and 12, another embodiment of a first stage combustor 500 is designed to produce about 6 MMBTU/hr by burning a gaseous fuel and air mixture or a liquid fuel and air mixture. Combustor 500 is made up of four sections 501, 502, 503, and 504 joined at pairs of flanges 505, 506 and 507 with gaskets (not shown).

A combustion chamber 512 extends centrally through burner 500. Combustion chamber 512 has a substantially cylindrical wall 514 that extends through second and third sections 502, 503, and that is made of a refractory material 519. When using a gaseous fuel mixture, the mixture flows into chamber 512 through four fuel ducts 521. Fuel ducts 521 have openings 522 that are structured to introduce the gaseous fuel mixture tangentially along side of wall 514 to create a vortical flow 525 from an upstream end 516 to a downstream end 518 located in fourth section 504. The fuel mixture is ignited by a pilot light 513 located downstream of duct openings 522.

Partially oxidized products of combustion are recirculated through a recirculation system 534. Combustion chamber 512 opens into a common, substantially cylindrical shaped recirculation inlet region 536 located in fourth section 504 at downstream end 518. Twelve straight recirculation tubing sections 540 extending the length of second and third sections 502, 504 and connect to recirculation inlet region 536. Each tubing section 540 also opens into a common, substantially cylindrical shaped recirculation outlet region 538 located in first section 501. An upstream wall 517 of combustion chamber 512 has a central recirculation opening 515 through which recirculation gases, comprised of the partially oxidized products of combustion, re-enter combustion chamber 512 from recirculation outlet region 538. As discussed above with reference to other embodiments, vortical flow 525 drives the recirculation. Recirculation inlet region 536 and recirculation outlet region 538 are lined with refractory material 519, which is rounded at respective outside corners 523, 524 to reduce pressure changes caused by turbulent flow. A downstream corner 526 of combustion chamber wall 514 and a central plug 550 in recirculation outlet region 538 are also rounded for the same reason. A test port 551 provides access to recirculation gases in recirculation outlet region 538.

Each section 501, 502, 503, 504 includes a respective annular shaped water jacket 561, 562, 563, and 564 that remove heat from burner 500. First section 501 also includes a water jacket 565 on an end wall 508. Water jackets 561, 562, 563, 564, 565 include respective water inlets 566, 567, 568, 569, 570, which are lined with steel walls. Water jackets 561, 562, 564, 565 in first, second and fourth sections 501, 502, and 504 include respective water outlets 571, 572, 574, 575 to connect to a steam dome 573, which-is coupled to water jacket 563. Heated water from jackets 561, 562, 563, 564, 565 can be used to preheat water in a boiler or steam generator being fired by a second stage burner, or can be used to for a process in an apparatus that employs heated process water. Note that recirculation tubes 540 are surrounded by water in water jackets 562, 563.

In one embodiment, recirculation tubes 540 include an interior heat exchanger to aid transfer of heat from the recirculation gases to the walls of recirculation tubes 540, which improves thermal transfer to water jackets 562, 563. One such heat exchanger is depicted in the lower recirculation tube 540 in FIG. 11. A flat metal strip 541 is thermally coupled to the inside surface of recirculation tube 540, for example, by welding metal strip 541 to recirculation tube 540. Metal strip 541 is twisted along the length of recirculation tube 540, which causes the recirculation gases to flow helically along metal strip 541. This tends to increase the contact between the recirculation gases and metal strip 541, and improves heat exchange. Metal strip 541 also absorbs heat from the recirculating gases, and reradiates the heat to the wall of recirculation tube 540. This further aids in transferring heat from the recirculating gases to the coolant.

One side of a secondary air manifold 548 is attached to an end flange 509 on fourth section 504. Manifold 548 surrounds and is attached to a central nozzle 528 that extends into a central outlet 526 of chamber 512 in downstream end 518. Nozzle 528 extends beyond another side of manifold 548 which will, when attached to a second stage furnace, provide an end wall 532 for a second stage combustion chamber. Eight secondary air inlet tubes 544 extend from end wall 532 and concentrically surround nozzle 528. An annular secondary air nozzle, such as annular nozzle 472 illustrated in FIG. 10B, can be employed with this embodiment.

In one embodiment, the distance from upstream end 516 to downstream end 518 is about 30.375 inches. Chamber 512 has a diameter of about 10.375 inches. Recirculation inlet area 536 is about 2.625 inches wide and recirculation outlet area 5386 is about 5.0 inches wide in the longitudinal direction. Central recirculation opening 515 and nozzle 528 have approximately the same diameter, about 6.0 inches. Each recirculation tube 540 has an inner diameter of about 2.25 inches, and is made from 0.25 inch all steel tubing. Fuel inlet ducts 540 are rectangular in cross section, and have a width in the longitudinal direction of about 4.0 inches, and a width in a transverse direction of about 2.0 inches.

The fuel can be switched to a liquid fuel in the embodiment illustrated in FIGS. 11 and 12. A liquid fuel, such as, for example, heating oil, is pumped through pipe 580 to radial nozzle 582, which is approximately centered between four fuel duct openings 522. Nozzle 582 can include an air jet supply (not shown), which also extends through pipe 580, that helps direct a spray of atomized fuel at a selected angle ranging between about 90° from the central axis of chamber 512 to a forward angle of approximately 30° from the central axis. The air jet also helps to turbulate and atomize a liquid or fluidized solid fuel. One type of air jet nozzle is a Swirl-Air™ type of atomizing nozzle provided by Delavan Corporation of West Des Moines, Iowa.

Simultaneously with the liquid fuel being sprayed from nozzle 582, primary air is pumped through fuel ducts 521 into chamber 512 to create vortical flow 525. The misted fuel becomes entrained in and mixed with the vortical air flow. It is important for reducing $NO_X$ formation that the total amount of air flowing into chamber 512 through ducts 521 and through nozzle 582 be between about 45–90% stoichiometric air. In all other respects, this embodiment operates the same as with a gaseous fuel mixture.

Normally, combustion chamber 512 will be fired with a gaseous fuel and oxidant mixture introduced through apertures 522, and then a liquid fuel will be added through nozzle 582. The gaseous fuel mixture may continue to flow in through apertures 522 while the liquid fuel is burned, or the gaseous fuel can be turned off and only an oxidant gas is introduced through apertures 522 to maintain vortical flow 525 in chamber 512 while burning the liquid fuel.

When only a gaseous fuel mixture is used, nozzle 582 can be withdrawn by sliding pipe 580 back through a slip fitting 584 attached to a feed-through plate 586. Pipe 580 includes an annulus 588 acting as a stop that abuts against slip fitting 584 when nozzle is positioned properly in chamber 512 for spraying a liquid fuel into vortical flow 525.

The fuel inlet cross-sectional area and the control of the inlet gas velocity are related issues. Too small a cross-sectional area will result in too large a velocity and pressure drop. Large pressures have been measured at the fuel mixture inlets to the first stage combustion chamber. We calculate that a velocity of about 100 ft/s or more is necessary to achieve a relatively stable recirculation rate. A velocity of this magnitude will provide an acceptable pressure drop.

To obtain a large turn-down ratio, which may be necessary in reduced load operation, fuel inlet ducts 521 should include controls. The fuel controls can also be used to control the fuel mixture velocity as the mass flow rate of the fuel mixture is increased. Referring to FIG. 12, A velocity control apparatus 590 (which is shown in only one of fuel inlet ducts 521 for simplicity of illustration) includes a tubing 591 that slip fits within duct 521 and a flange 592 that is bolted to a flange 593 on duct 521. A plate 594 is hinged to an inside wall of tubing 591 and extends downstream. Plate 594 is biased by a spring 595 toward a closed position that would substantially close duct 521. A rotatable control rod 596 extends through a feed-through 597 in apparatus 590, and connects to an eccentric disc 598. Turning control rod 596 turns eccentric disc 598, which in turn opens and closes plate 594. A control motor coupled to a process controller (both not shown) can be employed to turn rod.

Figure 13:
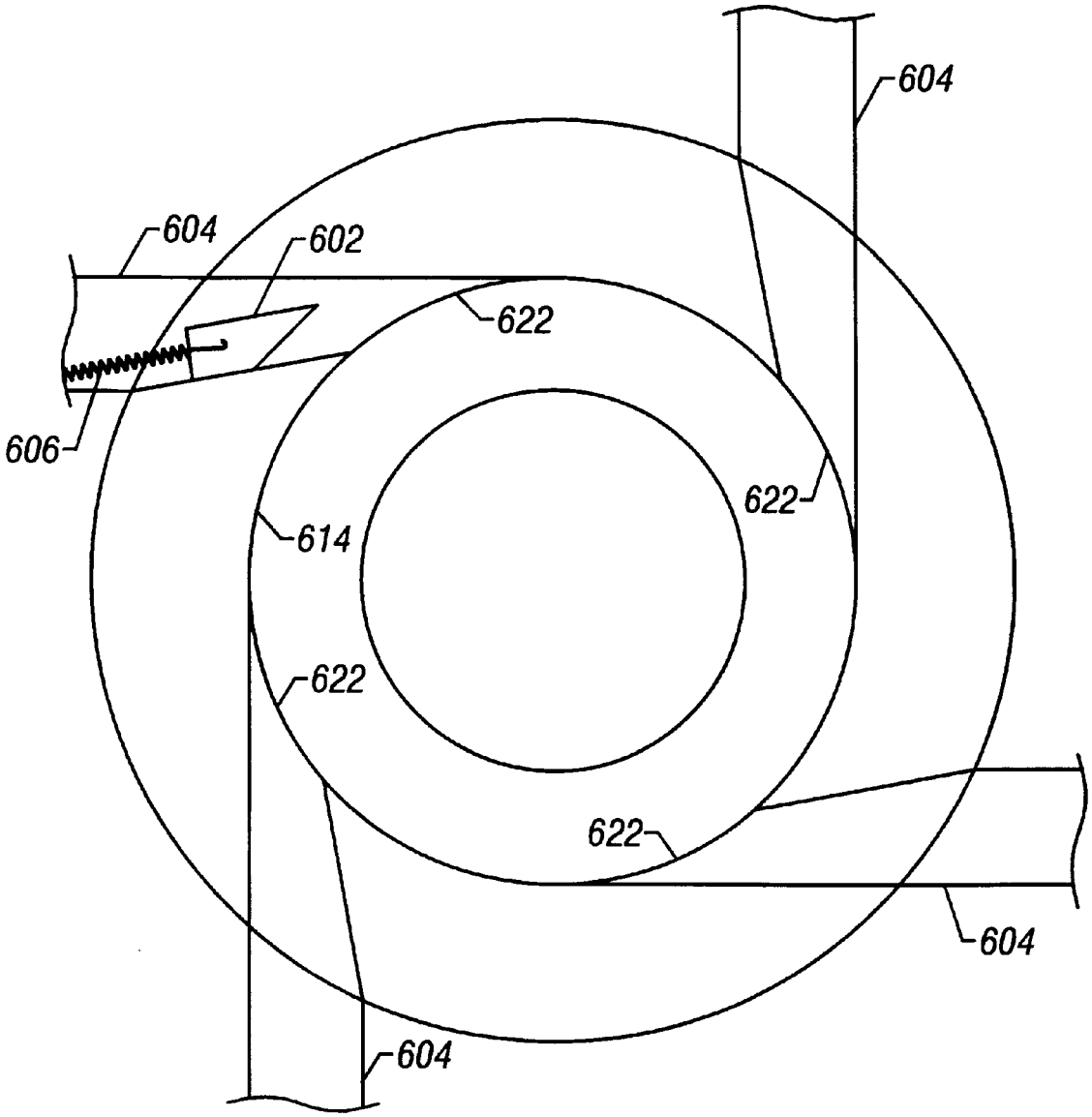
FIG. 13 is a schematic section view of a first stage combustor illustrating an arrangement for controlling the fuel inlet velocity.

Referring now to FIG. 13, another fuel velocity control apparatus includes, for each fuel inlet 622, a block 602 that is controllably moved through the fuel mixture channel 604 toward and away from the fuel inlet 622. A screw 606 or the like, operated by a control motor coupled to a process controller (both not shown) can be used to move block 602. In this embodiment, there could be about 4–10 fuel inlets 622 (only one shown in the drawing).

Figure 14:
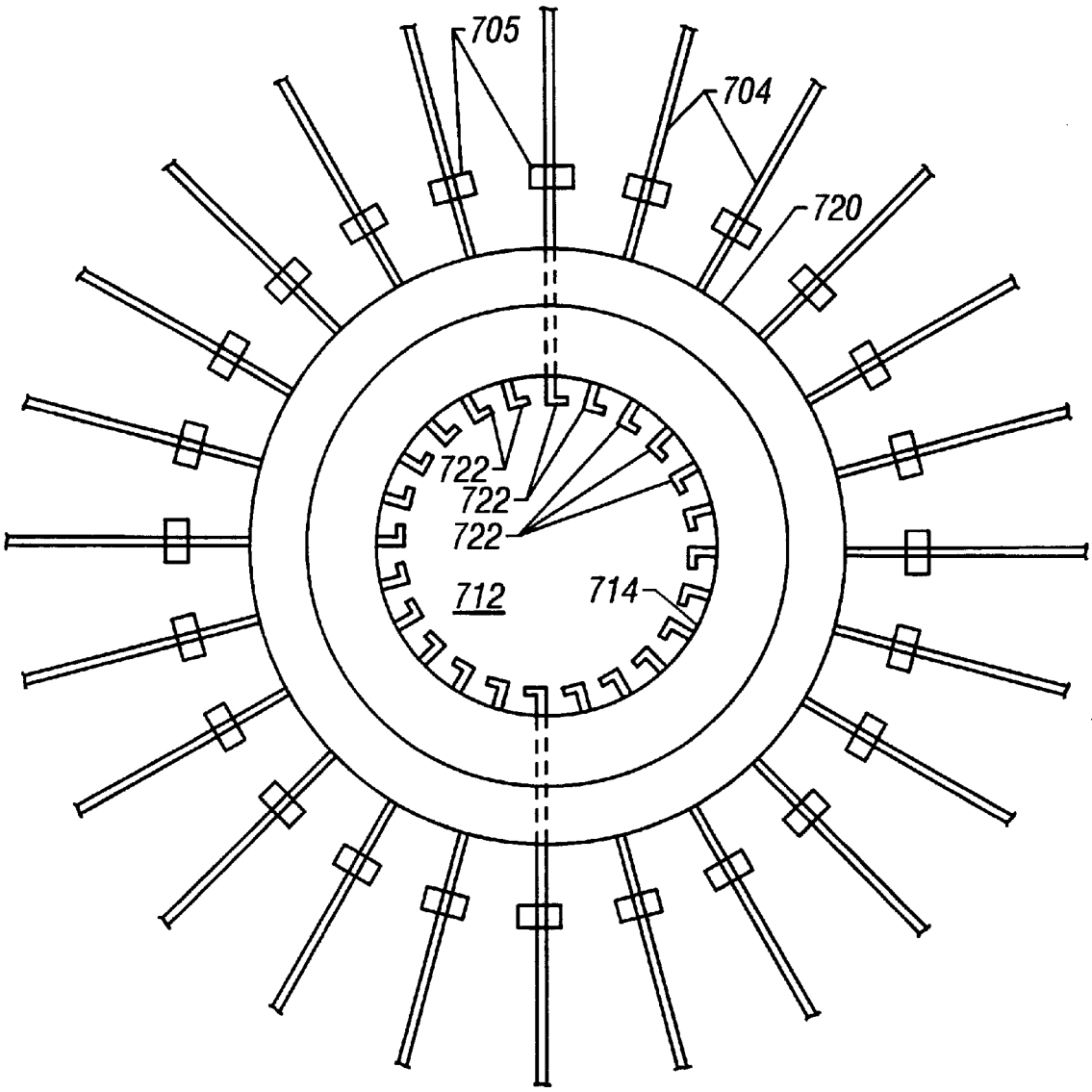
FIG. 14 is a schematic view of a fuel inlet ring of a first stage combustor illustrating a different arrangement for controlling the fuel inlet velocity.
Figure 15:
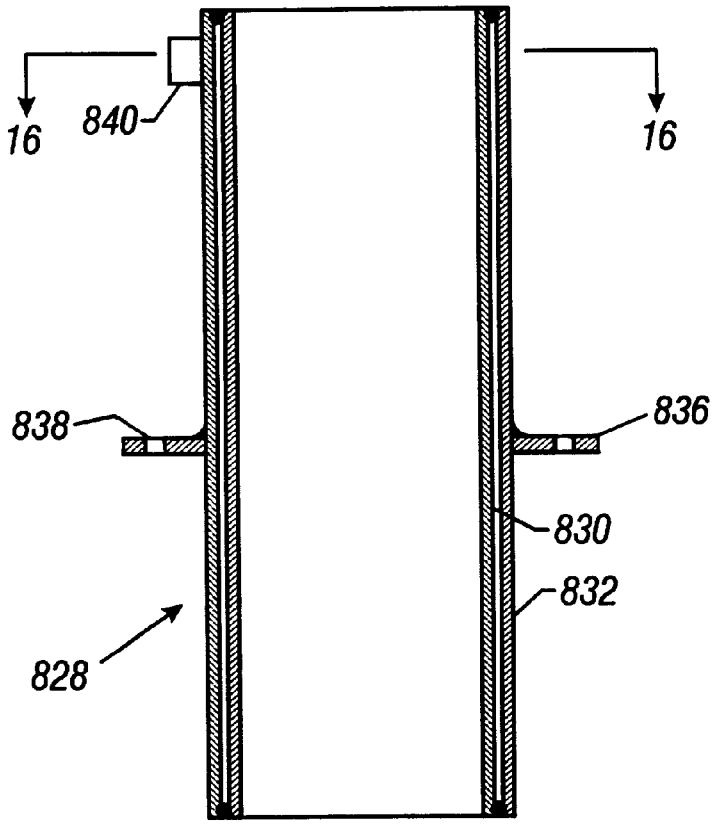
FIGS. 15–18 illustrate features of a water-cooled nozzle assembly.
Figure 16:
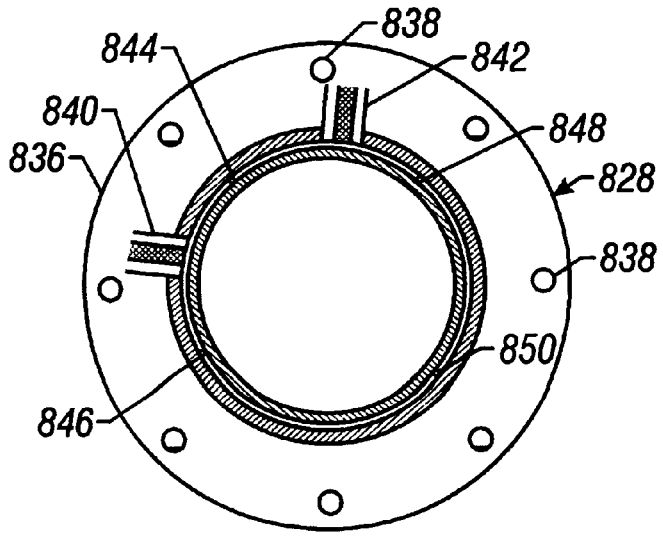
Figure 17:
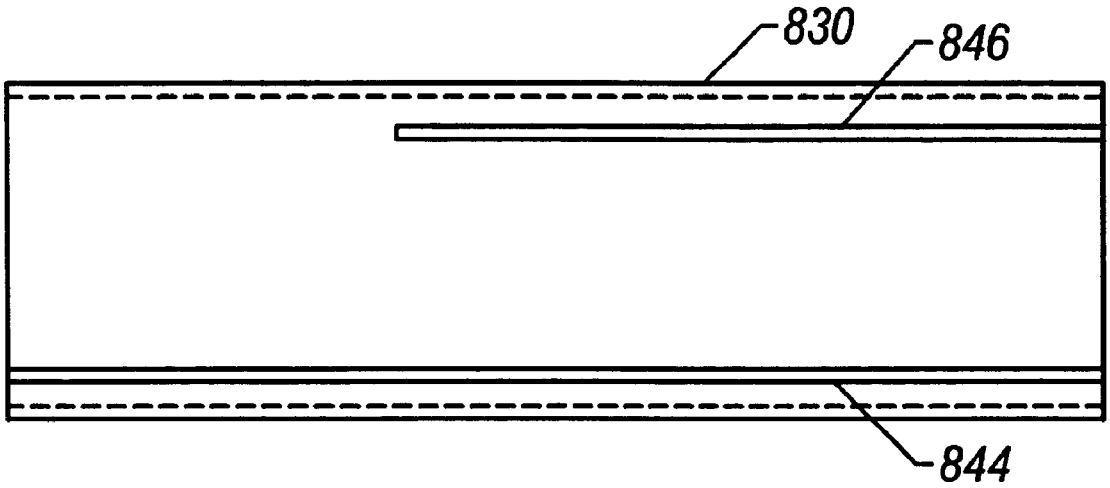
Figure 18:
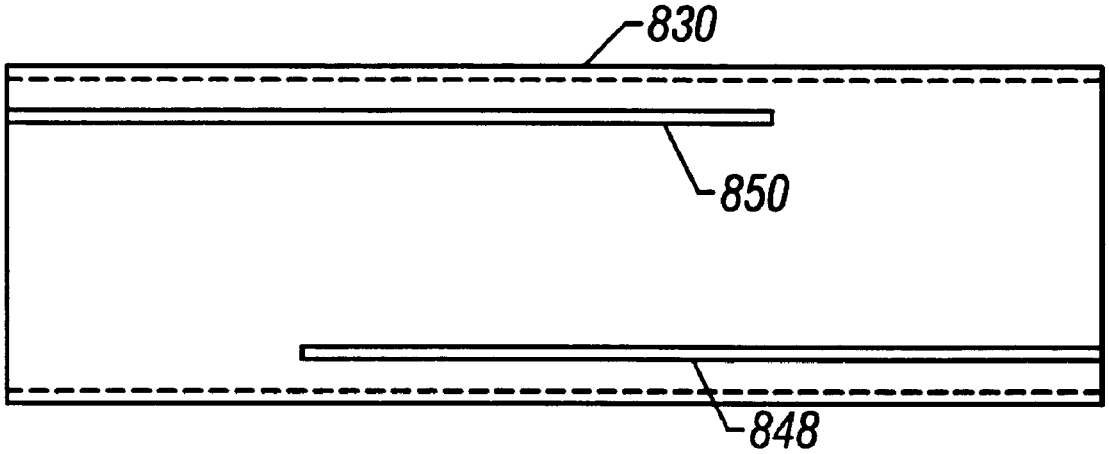

Yet another embodiment of a fuel velocity control apparatus is shown in FIG. 14. In this embodiment, a fuel inlet ring 720 includes about 20 or more fuel inlets 722 (24 being shown in FIG. 12), each consisting of a small tube 704 protruding through a wall 714 of a first combustion chamber 712. The ends of tubes 704 are all bent in the same direction to direct the fuel mixture tangentially along wall 714. Outside of chamber 712, each tube 704 includes an actuated valve 705. The total flow is controlled by opening and closing individual ones of valves 705. The flow velocity can be increased by opening additional valves.

The nozzle through which partially oxidized products of combustion flow into the second stage burner can include a cooling mechanism. Referring now to FIGS. 15–18, a water cooled nozzle 828 fabricated from 304 stainless steel includes an inner tube 830 surrounded by an outer tube 832. Water flows through a 0.25 inch gap between inner and outer tubes 830, 832. The gap is sealed at the ends of nozzle 828 by metal seals 834 welded to inner and outer tubes 830, 832.

A flange 836 is welded to the outer surface of outer tube 832. Flange 836 includes bolt holes 838 for attaching nozzle 828 to a wall of the second stage burner. An end of outer tube 832 that is not positioned within second stage furnace includes an inlet port 840 and an outlet port 842 for the cooling water. Ports 840, 842 are set about 90° apart. One longitudinal baffle 844 that extends the length of nozzle 828 is located about 45° from each of ports 840, 842. On the other sides of ports 840, 842 are two other longitudinal baffles 846, 848, each positioned about 90° from baffle 844. Baffles 846, 848 each extend about three-quarters the length of nozzle 828 from the end that includes ports 840, 842. A fourth longitudinal baffle 850 that extends about three-quarters the length of nozzle 828 from the other end is located about midway between baffles 846, 848 and about 180° from baffle 844. All baffles 844, 846, 848, 850 are tack welded to the outer surface of inner tube 830, and extend radially about to the inner surface of outer tube 832. Baffles 843, 846, 848, 850 are thus arranged to cause the cooling water to flow twice up and down the length of nozzle when flowing between inlet port 840 and outlet port 842. This provides a more uniform cooling of nozzle 828.

It will be understood that the multistage combustor of the invention can burn a variety of gaseous and liquid fuels. Gaseous hydrocarbon fuels can include natural gas, propane gas, process gas and the like. Liquid fuels include fuel oil, fluidized carbon powder slurry, an other burnable liquid hydrocarbon fuels.

Other embodiments are within the scope of the following claims.

What is claimed is:

1. A combustor for burning a mixture of a fuel and an oxidant, comprising:

a first combustion chamber, including an upstream end, a downstream end, and a longitudinal wall joining the ends, the wall having a longitudinally extending central axis;

at least one gas inlet arranged to introduce a flow of the oxidant to the upstream end to create a vortical flow from the upstream end to the downstream end;

a fuel inlet arranged to introduce the fuel to the upstream end to flow in a mixture with the vortical flow;

at least one recirculation channel, each including a recirculation channel inlet downstream of said gas inlet and a recirculation channel outlet upstream of the recirculation channel inlet, wherein the recirculation channel inlet is at a greater distance from the central axis than the recirculation channel outlet, the vortical flow causing a recirculated portion of the vortical flow to be extracted through the recirculation channel inlet and reintroduced through the recirculation channel outlet, the recirculation channel outlet arranged to reintroduce at least part of the recirculated portion of the vortical flow into the combustion chamber at a position a distance from the central axis;

an igniter upstream of the recirculation channel inlet for igniting the fuel and oxidant mixture in the first combustion chamber;

a second combustion chamber;

a combustion nozzle protruding into the second combustion chamber and communicating the downstream end of the first combustion chamber with the second combustion chamber;

a cooling jacket associated with the at least one recirculation channel to extract heat from the recirculated portion of the vortical flow, the cooling jacket including an inlet and an outlet for flowing a coolant through the cooling jacket;

a secondary air nozzle communicating secondary air to the second combustion chamber, the secondary air nozzle arranged to provide a flow of the secondary air in a substantially annular pattern from around and upstream of the combustion nozzle orifice and allowing combustion gases in the second combustion chamber to mix with the secondary air.

2. A combustor for burning a mixture of a fuel and an oxidant gas, comprising:

a combustion chamber including an upstream end, a downstream end, and a longitudinal wall joining the ends, the downstream end including a combustion chamber outlet;

a gaseous fuel inlet arranged to introduce a mixture of an oxidant gas and a gaseous fuel to the upstream end of the combustion chamber so as to create a vortical flow of the mixture moving towards the downstream end;

an igniter at the upstream end of the combustion chamber igniting the mixture; and a recirculation channel, including a recirculation channel inlet downstream of the fuel inlet and upstream from the combustion chamber outlet, and a recirculation channel outlet upstream of the recirculation channel inlet, wherein the recirculation channel inlet is at a greater distance from a longitudinal central axis of the combustion chamber than the recirculation channel outlet, and wherein the vortical flow urges a recirculated portion of partially oxidized products of combustion to be extracted from the combustion chamber through the recirculation channel inlet, to pass through the recirculation channel and to be reintroduced to the combustion chamber through the recirculation channel outlet.

3. The combustor of claim 2, further including a heat exchanger coupled to the at least one recirculation channel for removing heat from the partially oxidized products of combustion passing through the at least one recirculation channel.

4. The combustor of claim 3, further comprising a second combustion chamber that includes an inlet communicating with the combustion chamber outlet to provide partially oxidized products of combustion to the second combustion chamber and a secondary air inlet for providing secondary air to further oxidize the partially oxidized products of combustion in the second combustion chamber.

5. The combustor of claim 4, wherein the heat exchanger comprises a cooling jacket substantially surrounding the at least one recirculation channel and the combustion chamber, the cooling jacket including a coolant inlet and a coolant outlet for flowing a coolant therethrough.

6. The combustor of claim 5, wherein the coolant comprises air, and wherein the coolant outlet communicates with the secondary air inlet to provide heated secondary air to the second combustion chamber.

7. The combustor of claim 5, wherein the coolant comprises a liquid.

8. The combustor of claim 5, further comprising an apparatus employing heat, wherein the coolant outlet communicates heated coolant to the apparatus employing heat.

9. The combustor of claim 3, wherein the heat exchanger includes fins coupled to the recirculation tube.

10. The combustor of claim 9, wherein the fins are coupled to an inside wall of the recirculation channel.

11. The combustor of claim 9, wherein the fins are coupled to an outside wall of the recirculation channel.

12. The combustor of claim 2, wherein the recirculation channel comprises a plurality of parallel flow recirculation channels being arrayed at angularly spaced locations with respect to the central axis, each having a respective recirculation channel inlet which opens into the combustion chamber wall and each communicating with the recirculation channel outlet.

13. The combustor of claim 2, wherein the recirculation channel outlet is arranged to direct a flow of the recirculated portion of combustion gases into the combustion chamber in a direction substantially parallel with the central axis.

14. The combustor of claim 2, wherein the recirculation channel outlet is arranged to preheat the mixture before the mixture is ignited.

15. The combustor of claim 2, wherein the oxidant is selected from the group consisting of air, oxygen, oxygen enriched air, and oxygen depleted air.

16. The combustor of claim 2, further comprising a fuel nozzle connected to a liquid fuel line for communicating a liquid fuel from outside the combustor to the combustion chamber.

17. The combustor of claim 16, wherein the fuel nozzle is movable between an extended position arranged to direct an atomized flow of the liquid fuel into the vortical flow and a retracted position out of the vortical flow.

18. The combustor of claim 2, further comprising a mixer communicating with the gaseous fuel inlet, wherein the mixer is adapted to create a substantially homogeneous mixture of the gaseous fuel and the oxidant.

19. The combustor of claim 2, wherein the longitudinal wall is substantially cylindrical.

20. A combustor for burning a mixture of fuel and an oxidant gas, comprising:

a cylindrical combustion chamber, including an upstream end, a downstream end, a longitudinal wall joining the ends, and a combustion chamber outlet at the downstream end;

a fuel inlet arranged to introduce a flow of the fuel into the combustion chamber at the upstream end;

at least one gas inlet arranged to introduce a flow of the oxidant gas into the combustion chamber at the upstream end, creating a flow of the fuel and oxidant mixture from the upstream end to the downstream end;

an igniter for igniting the mixture in the combustion chamber;

a recirculation channel inlet downstream of the gas inlet and upstream of the combustion chamber outlet, arranged to extract a portion of partially oxidized products of combustion from the combustion chamber;

a recirculation channel outlet upstream of the recirculation channel inlet, arranged to reintroduce said portion of partially oxidized products of combustion to the combustion chamber off of a central axis thereof; and a recirculation channel connecting between the recirculation channel inlet and the recirculation channel outlet, wherein the gas inlet comprises a plurality of gas inlet openings in the cylindrical wall of the cylindrical combustion chamber, wherein the plurality of gas inlet openings are arranged to cause the mixture and the partially oxidized products of combustion to vortically flow from the upstream end to the downstream end in the combustion chamber, and wherein the vortical flow causes a portion of the partially oxidized products of combustion to recirculate through the recirculation channel.

21. The combustor of claim 20, wherein the recirculation channel outlet comprises a plurality of openings approximately centered on the central axis of the combustion chamber.

22. The combustor of claim 20, wherein the recirculation channel outlet has a cross sectional area sufficient to pass the recirculated gas without creating a pressure drop greater than about a pressure drop caused by the recirculation channel.

23. The combustor of claim 20, wherein the at least one gas inlet comprises the fuel inlet, and wherein the fuel comprises a gaseous fuel.

24. The combustor of claim 23, further comprising a mixer with the at least one gas inlet, wherein the mixer is adapted to create a substantially homogeneous mixture of the gaseous fuel and the oxidant.

25. The combustor of claim 20, wherein the fuel inlet comprises a fuel nozzle connected to a fuel line for communicating a liquid fuel from outside the combustor to the combustion chamber.

26. A multiple-stage combustor, comprising:

an upstream combustion chamber;

a downstream combustion chamber having an end wall; and a nozzle communicating partially oxidized products of combustion from the upstream combustion chamber to the downstream combustion chamber, the nozzle protruding from the end wall into the downstream combustion chamber.

27. The multiple-stage combustor of claim 26, wherein the nozzle is formed of a nozzle material capable of withstanding temperatures approximately equal to or greater than 1400° F. without significant damage.

28. The multiple-stage combustor of claim 26, wherein the nozzle comprises a cooling mechanism.

29. The multiple-stage combustor of claim 28, wherein the cooling mechanism comprises a coolant channel permitting a coolant fluid to pass therethrough.

30. The multiple-stage combustor of claim 26, further comprising:

a secondary air inlet to the downstream combustion chamber, being structured and arranged to provide a flow of secondary air to the downstream combustion chamber in a substantially annular shaped flow pattern around the partially oxidized products of combustion exiting the combustion channel.

31. The multiple-stage combustor of claim 30, wherein the secondary air inlet comprises a plurality of secondary air tubes opening into the downstream combustion chamber, the secondary air tubes being arrayed around the nozzle in a substantially circular arrangement.

32. The multiple-stage combustor of claim 31, wherein the plurality of secondary air tubes protrude at least about as deep into the downstream combustion chamber as does the nozzle.

33. A multiple-stage combustor, comprising:

an upstream combustion chamber;

a downstream combustion chamber having an end wall;

a combustion channel communicating partially oxidized products of combustion from the upstream combustion chamber through the end wall into the downstream combustion chamber; and a secondary air inlet to the downstream combustion chamber, being structured and arranged to provide a flow of secondary air to the downstream combustion chamber in a substantially annular shaped flow pattern around the partially oxidized products of combustion exiting the combustion channel.

34. The combustor of claim 33, wherein the combustion channel extends through a nozzle protruding from the end wall a distance into the downstream combustion chamber.

35. The combustor of claim 34, wherein the secondary air inlet provides the annular shaped flow at a distance from the end wall being at least about as great as the distance that the nozzle protrudes from the end wall.

36. The combustor of claim 35, wherein the secondary air inlet comprises a plurality of secondary air tubes extending into the downstream combustion chamber, the secondary air tubes being arrayed around the nozzle in a substantially circular arrangement.

37. The combustor of claim 35, wherein the secondary air inlet provides a flow of secondary air sufficient to entrain gases from the downstream combustion chamber into a flow that passes between the secondary air inlet and the nozzle.

38. The combustor of claim 33, further comprising a heat exchanger structured and arranged to preheat the secondary air with heat extracted from the upstream combustion chamber prior to introducing the secondary air into the downstream combustion chamber.

39. A multi-stage combustor, comprising:

a fuel mixing system being structured and arranged to provide a continuous flow of a fuel mixture comprised of a gaseous fuel and an oxidant with about 45% to about 90% stoichiometric oxygen, the fuel mixing system including a fuel inlet, an oxidant inlet, and a fuel mixture outlet;

a first combustion chamber for partially oxidizing the fuel mixture and producing partially oxidized products of combustion, including a fuel mixture inlet communicating with the fuel mixture outlet, and a fuel igniter; and a second combustion chamber communicating with the first combustion chamber for further oxidizing the partially oxidized products of combustion, including a secondary oxidant inlet structured and arranged to introduce into the second combustion chamber additional oxidant sufficient to completely oxidize the partially oxidized products of combustion, wherein the first combustion chamber includes a substantially cylindrical shaped wall extending between an upstream end and a downstream end, the downstream end including an outlet for the partially oxidized products of combustion communicating with the second combustion chamber, and wherein the fuel mixture inlet comprises a plurality of fuel mixture inlet apertures near the upstream end of the cylindrical wall being structured and arranged to provide a flow of the fuel mixture into the first combustion chamber with sufficient velocity tangential to the cylindrical wall to create a vortical flow of the fuel mixture within the first combustion chamber.

40. The combustor of claim 39, wherein the mixing system is adapted to provide a substantially homogeneous fuel mixture.

41. The combustor of claim 39, wherein the oxidant mixed with the gaseous fuel comprises air and wherein the additional oxidant comprises air.

42. The combustor of claim 40, wherein the mixing system further comprises a mixer adapted to provide a fuel mixture comprised of the oxidant and one of a liquid fuel and a fluidized solid particulate fuel, the mixer having an outlet located approximately centrally between the plurality of fuel mixture inlet apertures.

43. The combustor of claim 39, further comprising at least one recirculation channel for recirculating partially oxidized products of combustion from the downstream end of the first combustion chamber to the upstream end of the first combustion chamber, each recirculation channel including a recirculation channel inlet downstream of said fuel mixture inlet and a recirculation channel outlet upstream of the recirculation channel inlet, wherein the recirculation channel inlet is at a greater radial distance from a central axis of the first combustion chamber than the recirculation channel outlet, the vortical flow causing a recirculated portion of the vortical flow to flow into the recirculation channel inlet and causing the recirculated portion to flow out of the recirculation channel outlet.

44. The combustor of claim 43, wherein the at least one recirculation channel comprises a plurality of recirculation channels, the recirculation channel inlets being circumferentially spaced in the cylindrical wall near the downstream end of the first combustion chamber.

45. The combustor of claim 44, further comprising a combustion channel extending between a downstream end wall of the first combustion chamber to an upstream end wall of the second combustion chamber, wherein the secondary oxidant inlet provides a secondary oxidant flow into the second combustion chamber that substantially surrounds and is substantially parallel with a flow of partially oxidized products of combustion flowing out of the combustion channel.

46. The combustor of claim 45, further comprising a nozzle projecting from the upstream end wall of the second combustion chamber, wherein the combustion channel extends through the nozzle, and wherein the secondary oxidant inlet comprises a plurality of secondary oxidant tubes extending into the second combustion chamber.

47. The combustor of claim 43, further comprising a heat exchanger structured and arranged to extract heat from the at least one recirculation channel.

48. The combustor of claim 47, wherein the heat exchanger comprises a jacket around the upstream combustion chamber and the recirculation channels, including a jacket inlet through which a coolant flows into the jacket and a jacket outlet through which heated coolant flows out of the jacket.

49. The combustor of claim 48, wherein the coolant comprises air, and the jacket outlet communicates with the secondary oxidant inlet.

50. The combustor of claim 49, wherein the coolant comprises a liquid coolant.

51. An apparatus for converting a single stage burner into a two stage burner, comprising:

a first stage burner, including a substantially cylindrical combustion chamber, a fuel inlet system introducing a mixture of a fuel and less than stoichiometric oxygen into an upstream end of the combustion chamber and causing the mixture to flow vortically towards a downstream end of the combustion chamber, an igniter near the upstream end for igniting the mixture, at least one recirculation channel recirculating partially oxidized products of combustion from the downstream end to the upstream end, and a combustion product outlet at the downstream end; and flange means adapted to couple between the first stage burner and a combustion chamber of the single stage burner, including a central nozzle communicating a flow of partially oxidized products of combustion from the combustion product outlet to the combustion chamber of the single stage burner, and a secondary air passage communicating secondary air into the combustion chamber of the single stage burner, wherein the secondary air passage is arranged to provide a flow of secondary air that substantially surrounds the flow of partially oxidized products of combustion from the central nozzle.

52. A method of reducing $NO_X$ emissions while combusting a fuel, comprising:

forming a mixture of the fuel and about 45% to about 90% stoichiometric oxygen;

generating a vortical flow of the mixture in a first combustion chamber from an upstream end to a downstream end of the combustion chamber;

igniting the vortically flowing mixture to form partially oxidized products of combustion;

recirculating a portion of the partially oxidized products of combustion from the upstream end to the downstream end;

mixing the recirculated partially oxidized products of combustion with additional mixture in the vortical flow;

communicating a second portion of the partially oxidized products of combustion th rough an outlet at the downstream end into a second combustion chamber; and further oxidizing the second portion of the partially oxidized products of combustion in the second combustion chamber.

53. The method of claim 52, wherein further oxidizing includes providing a flow of secondary air into the second combustion chamber that substantially surrounds the second portion of the partially oxidized products of combustion communicated into the second combustion chamber, and inducing a flow of flue gases in the second combustion to mix with and cool the second portion of the partially oxidized products of combustion and secondary air.

54. The method of claim 53, wherein communicating the second portion of the partially oxidized products of combustion into the second combustion chamber includes flowing the second portion of the partially oxidized products of combustion into the second combustion chamber through a nozzle protruding into the second combustion chamber.

55. The method of claim 52, wherein forming the mixture of the fuel oxygen includes forming a substantially homogenous mixture.

* * * * *